US008726678B2

(12) United States Patent
Turney et al.

(10) Patent No.: US 8,726,678 B2
(45) Date of Patent: May 20, 2014

(54) CONTROLLERS AND METHODS FOR PROVIDING COMPUTERIZED GENERATION AND USE OF A THREE DIMENSIONAL SURGE MAP FOR CONTROL OF CHILLERS

(75) Inventors: Robert D. Turney, Watertown, WI (US); Kirk H. Drees, Cedarburg, WI (US); Brett M. Lenhardt, Waukesha, WI (US); Curtis C. Crane, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 844 days.

(21) Appl. No.: 12/907,778

(22) Filed: Oct. 19, 2010

(65) Prior Publication Data

US 2011/0093133 A1 Apr. 21, 2011

Related U.S. Application Data

(60) Provisional application No. 61/253,291, filed on Oct. 20, 2009.

(51) Int. Cl.
*F25B 49/00* (2006.01)

(52) U.S. Cl.
USPC ..... 62/126; 62/127

(58) Field of Classification Search
USPC ..... 62/125, 126, 127, 185, 201; 700/276
See application file for complete search history.

(56) References Cited

U.S. PATENT DOCUMENTS

| | | | | |
|---|---|---|---|---|
| 4,627,788 | A * | 12/1986 | Keyes et al. | 415/11 |
| 4,640,665 | A * | 2/1987 | Staroselsky et al. | 415/1 |
| 4,831,535 | A | 5/1989 | Blotenberg | |
| 4,949,276 | A | 8/1990 | Staroselsky et al. | |
| 5,355,691 | A | 10/1994 | Sullivan et al. | |
| 5,553,997 | A | 9/1996 | Goshaw et al. | |
| 5,798,941 | A | 8/1998 | McLeister | |
| 7,025,558 | B2 | 4/2006 | Blotenberg | |
| 7,824,148 | B2 | 11/2010 | Tetu et al. | |
| 2010/0263391 | A1 | 10/2010 | Tetu et al. | |

FOREIGN PATENT DOCUMENTS

| | | | |
|---|---|---|---|
| JP | 01-129397 | A | 5/1989 |
| JP | 06-288390 | A | 10/1994 |
| JP | 08-014191 | A | 1/1996 |
| JP | 2007-509268 | A | 4/2007 |
| JP | 2007-212040 | A | 8/2007 |
| WO | WO 2009/058975 | A1 | 5/2009 |

OTHER PUBLICATIONS

York by Johnson Controls, Optiview Control Center Overview, Surge Map Screen—Table View (Software version C.OPT.01.19.307 and later), Jul. 15, 2008, 1 page.

* cited by examiner

*Primary Examiner* — Marc Norman
(74) *Attorney, Agent, or Firm* — Foley & Lardner LLP

(57) ABSTRACT

A controller for a chiller includes processing electronics configured to detect a plurality of surge events. The processing electronics calculate a point for each detected surge event in at least a three dimensional coordinate system. The three dimensional coordinate system describes at least three conditions of the chiller when the surge event was detected. The processing electronics are configured to calculate a surface map for the at least three dimensional coordinate system using the calculated points. The processing electronics are further configured to control at least one setpoint for the chiller using the calculated surface map.

24 Claims, 15 Drawing Sheets

CONTROLLERS AND METHODS FOR PROVIDING COMPUTERIZED GENERATION AND USE OF A THREE DIMENSIONAL SURGE MAP FOR CONTROL OF CHILLERS

CROSS-REFERENCE TO RELATED APPLICATIONS

The present application claims the benefit of U.S. Provisional Application No. 61/253,291, filed Oct. 20, 2009, the entirety of which is hereby incorporated by reference.

BACKGROUND

The present invention relates generally to systems and methods for controlling chillers of chilled fluid systems.

A chiller controller typically uses one or more parameters to control the operation of a chiller. These parameters can be controlled to reduce the power consumed by the chiller, but such control can also cause a surge condition. It is challenging and difficult to develop systems and methods for controlling chillers for energy efficiency and to avoid surge conditions.

SUMMARY

One embodiment of the invention relates to a controller for a chiller. The controller has processing electronics configured to detect a plurality of surge events and to calculate a point for each detected surge event in at least a three dimensional coordinate system that describes at least three conditions of the chiller when the surge event was detected. The processing electronics are configured to calculate a surface map for the at least three dimensional coordinate system using the calculated points. The processing electronics are further configured to control at least one setpoint for the chiller using the calculated surface map.

Another embodiment of the invention relates to a controller for a chiller. The controller includes processing electronics configured to display a graphical rendering of a surface map in a three dimensional coordinate system. The three dimensional coordinate system may have the axis of chiller differential pressure, compressor prerotation vane position, compressor motor variable speed drive frequency. The surface map is configured to display points in the three dimensional coordinate system representative of actual compressor surge coordinates and points that represent coordinates where a surge is estimated to occur. The processing electronics may be configured to dynamically update the graphical representation of the surface map as compressor surges occur. A plurality of regions may be indicated on the surface map using at least one of coloring, shading, labeling and another graphical indicia. The regions may include a first region where a compressor surge is estimated to occur if the chiller is operated within the first region. The regions may include a surge map margin region wherein the chiller is estimated to be able to operate near the first region, but without a surge event actually occurring. The regions may include an operating region wherein the chiller is estimated to operate without risk of a potential surge event based on current estimations. The processing electronics may be configured to cause a graphical representation of a history for the surface map to be displayed. The processing electronics may be configured to highlight a point representative of the chiller's current operational state. The processing electronics may be configured to seek local minimums of compressor motor variable speed drive frequency within a limited range of prerotation vane positions.

Another embodiment of the invention relates to a method of controlling a chiller. The method includes maintaining a surface map in memory. Maintaining the surface map includes generating the surface map and updating the surface map using measured data from the chiller. The method also includes calculating or obtaining a current state for the chiller. The method further includes predicting a surge condition based on the current state and the surface map. The method yet further includes implementing a control measure estimated to avoid the predicted surge condition.

Another embodiment of the invention relates to a computerized method for controlling a chiller. The method includes using processing electronics of a controller for the chiller to detect a plurality of chiller surge events. The method further includes using the processing electronics to calculate a point for each detected surge event in at least a three dimensional coordinate system that describes at least three conditions of the chiller associated with the detected surge event. The method also includes using the processing electronics to calculate a surface map for the at least three dimensional coordinate system using the calculated points. The method further includes using the processing electronics to control at least one setpoint for the chiller using the calculated surface map. In some embodiments, the method may further include calculating a current state of the chiller and predicting a surge condition based on the current state and the surface map. The method may also include implementing a control measure estimated to avoid the predicted surge condition. The method may also or alternatively include estimating a potential surge point and adding the estimated potential surge point to the surface map. The potential surge point can be classified as a generated surge point and a point calculated based on a detected surge point can be classified as an actual surge point. The method can further include controlling the chiller differently when chiller conditions are approaching an actual surge point relative to when chiller conditions are approaching a generated surge point. The method may also include periodically controlling the chiller to test the generated surge points. A generated surge point can be replaced with an actual surge point when the compressor surges in response to testing to the generated surge point. The controller may be coupled to an electronic display system and the method may further include causing the electronic display system to display a rendering of the surface map.

Another embodiment of the invention relates to a controller for a chiller. The controller includes processing electronics configured to receive information regarding a plurality of surge events and to calculate a point for each surge event using the received information. The processing electronics calculates the point for each surge event in at least a three dimensional coordinate system that describes at least three conditions of the chiller when the surge event occurred. The processing electronics are configured to calculate a surface map for the at least three dimensional coordinate system using the calculated points. The processing electronics are further configured to control at least one setpoint for the chiller using results of the surface map calculation. The surface map results may be calculated and stored in a table, matrix, mark-up language, or another data structure for describing points, surfaces, or objects in a three dimensional coordinate system.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the Figures, controllers and methods for providing computerized generation and use of a three dimensional surge map for control of chillers are shown and described.

Figure 1:
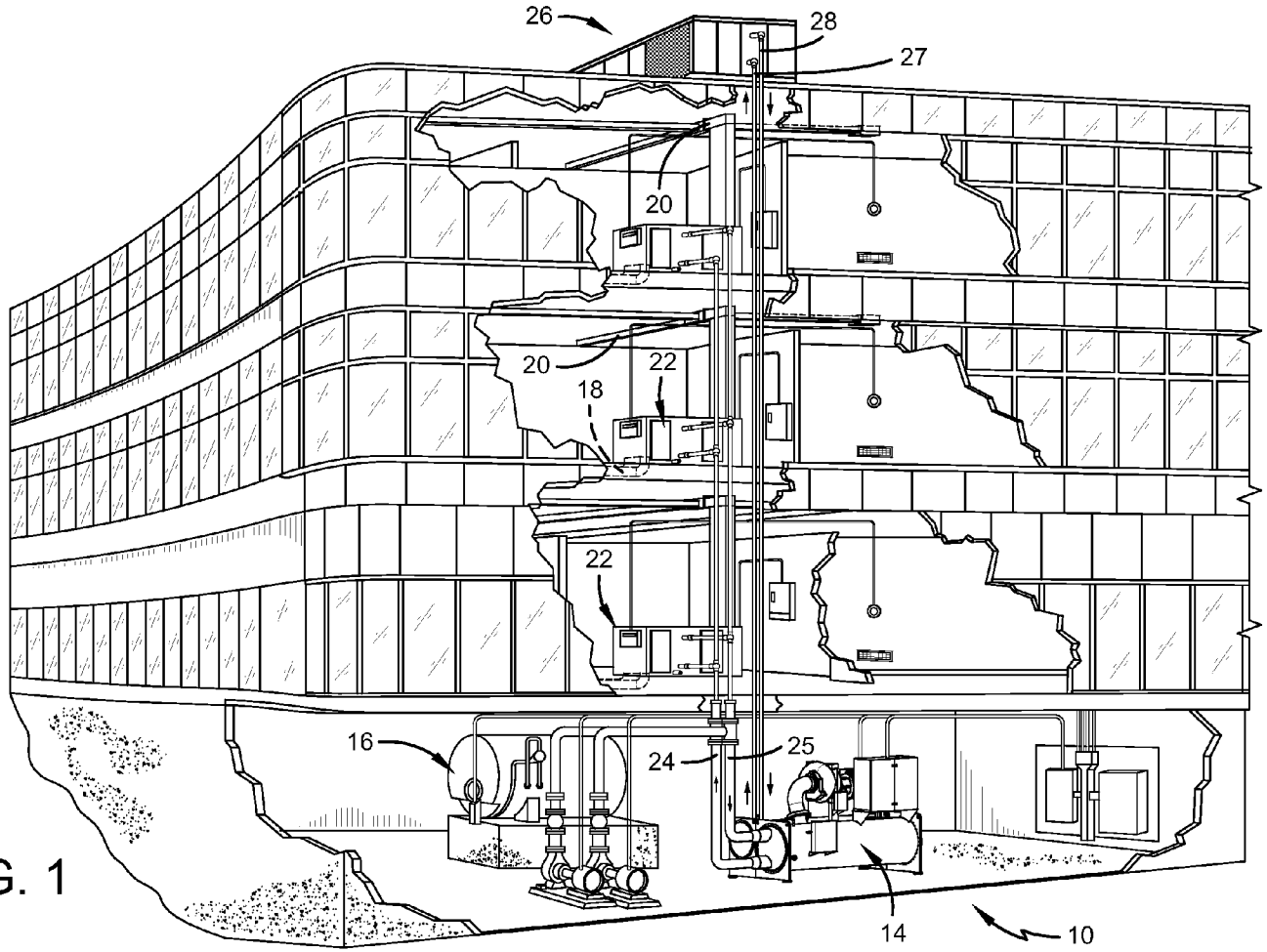
FIG. 1 is a perspective view of a building with a building management system (BMS), according to an exemplary embodiment.

Referring to FIG. 1, a perspective view of a building 10 is shown. The illustration of building 10 includes a cutaway view of an exemplary building management system that includes a heating, ventilation, and air conditioning system (HVAC) system.

One type of HVAC system uses a chilled fluid to remove heat from a building and is typically referred to as a chilled fluid system. In this type of system, a chilled fluid is used to remove heat from building 10. The chilled fluid is placed in a heat exchange relationship with the cooling load from the building, usually warm air, via a plurality of air handling units 22. During the heat exchange with the cooling load in air handling units 22, the chilled fluid receives heat from the load (i.e., the warm air) and increases in temperature. The chilled fluid thereby removes heat from the load (e.g., warm air passing over piping in fan coil units, air handling units, or other air conditioning terminal units through which the chilled fluid flows). The resulting changed load (e.g., cooler air) is provided from air handling units 22 to building 10 via an air distribution system including air supply ducts 20 and air return ducts 18.

The HVAC system shown in FIG. 1 includes a separate air handling unit 22 on each floor of building 10, but components such as air handling unit 22 or ducts 20 may be shared between or among multiple floors. Boiler 16 can add heat to the air passing through air handling units 22 when conditions exist to warrant heating.

The chilled fluid is no longer chilled after receiving heat from the load in air handling units 22. To re-chill the fluid for recirculation back to the air-handling units, the fluid is returned to chiller 14 via piping 25.

In the embodiment of FIG. 1, water (or yet another chilled fluid) flows through tubes in the condenser of the chiller 14 to absorb heat from the refrigerant vapor and causes the chiller's refrigerant to condense. The water flowing through tubes in the condenser is pumped from the chiller 14 to a cooling tower 26 via piping 27. The cooling tower 26 utilizes fan driven cooling of the water or fan driven evaporation of the water to remove heat from the water delivered to cooling tower 26 via piping 27. The water cooled by cooling tower 26 is provided back to chiller 14's condenser via piping 28.

Figure 2:
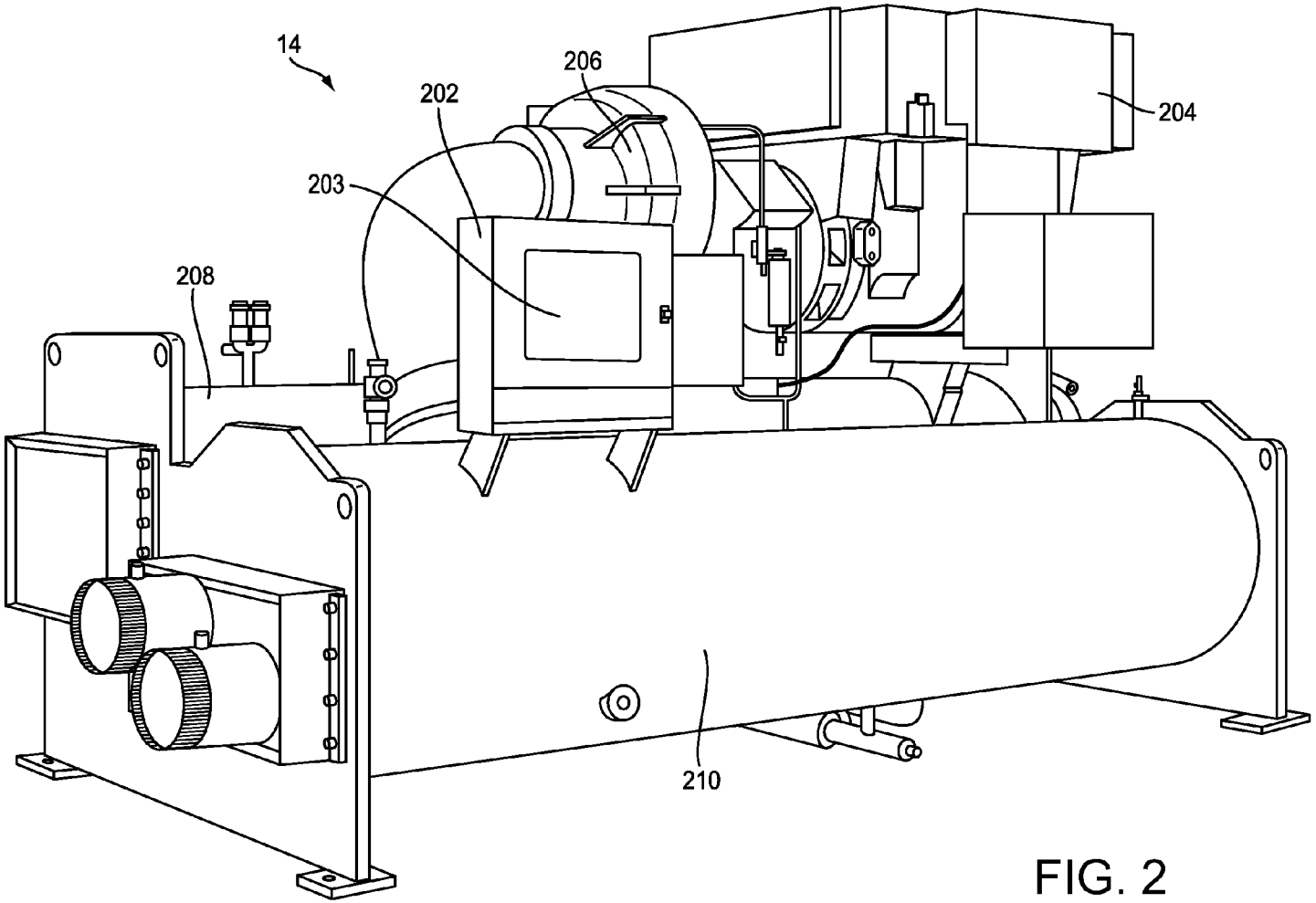
FIG. 2 is an illustration of an exemplary chiller, according to an exemplary embodiment.
Figure 3:
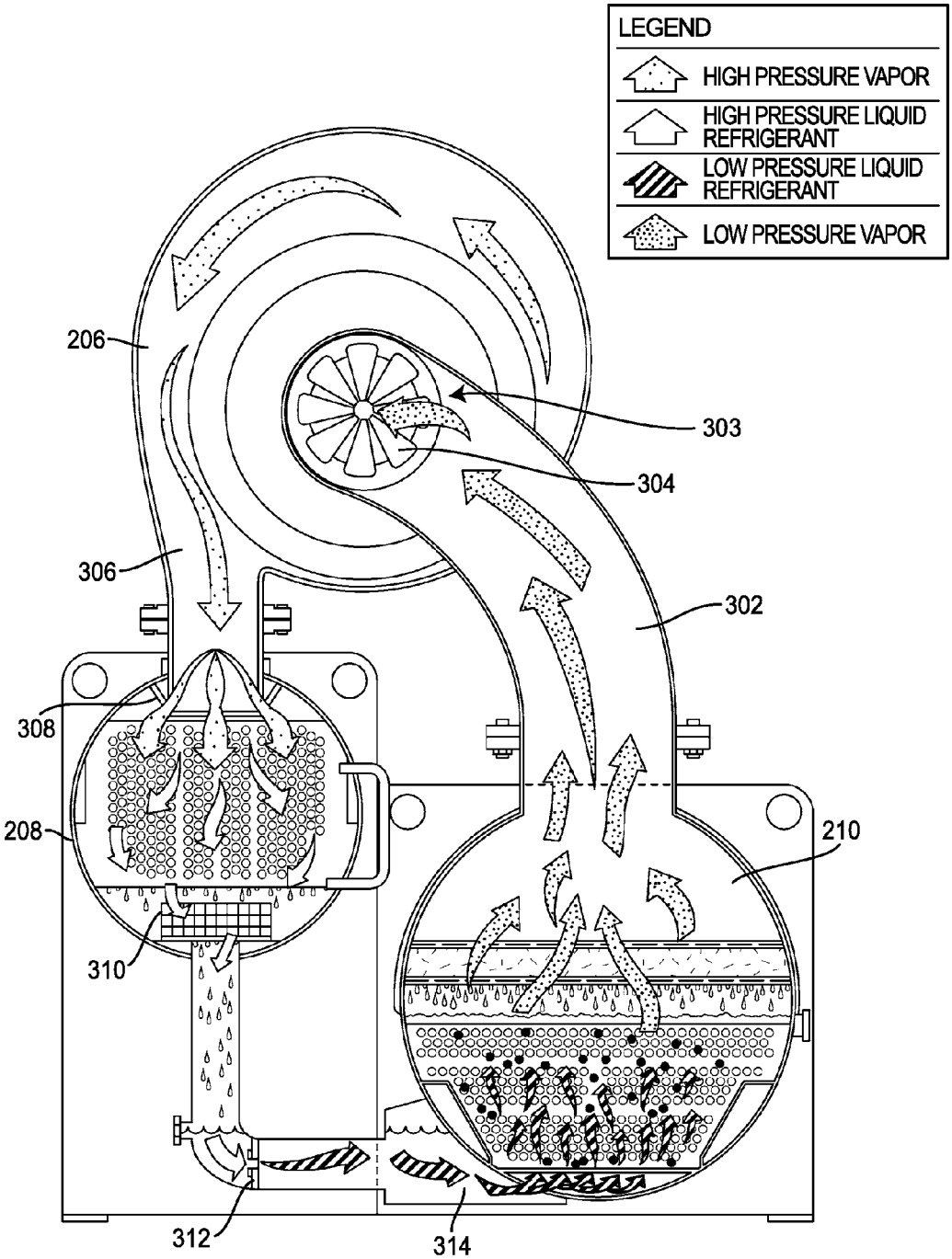
FIG. 3 is a simplified cut-away diagram of the chiller of FIG. 2 and its operation, according to an exemplary embodiment.

A chiller and its operation are illustrated in FIGS. 2-3, according to an exemplary embodiment. Chiller 14 is shown to include evaporator 210, which provides a heat exchange between the fluid returned from the HVAC system and another fluid, such as a refrigerant. The refrigerant in evaporator 210 of chiller 14 removes heat from the chilled fluid during the evaporation process, thereby cooling the chilled fluid. The refrigerant absorbs heat from the chilled fluid and changes from a boiling liquid and vapor state to vapor inside evaporator 210. The chilled fluid is then circulated back to the air handling units 22 via piping 24, as illustrated in FIG. 1, for subsequent heat exchange with the load.

Suction at portion 302 causes the refrigerant vapor to flow into compressor 206 of chiller 14 where compressor 206 has a rotating impeller 303 (or another compressor mechanism such as a screw compressor, scroll compressor, reciprocating compressor, centrifugal compressor, etc.) that increases the pressure and temperature of the refrigerant vapor and discharges it into condenser 208. The impeller 303 is driven by motor 204, which may have a variable speed drive (e.g., variable frequency drive). The impeller may further include or be coupled to an actuator that controls the position of prerotation vanes 304 at the entrance to the impeller of compressor 206.

Discharge at portion 306 from compressor 206 passes through discharge baffle 308 into condenser 208 and through sub-cooler 310, controllably reducing the discharge back into a liquid form. The liquid then passes through flow control orifice 312 and through oil cooler 314 to return to evaporator 210 to complete the cycle.

In the embodiment shown in FIG. 2, chiller 14 includes a controller 202 coupled to an electronic display 203 such as a touch screen at which settings for chiller 14 may be adjusted by a user. Controller 202 also has a processing circuit configured to adjust components of the chiller to meet, for example, pressure and temperature setpoints for the chilled fluid or refrigerant systems. For example, as a building's heating load changes, chiller components such as prerotation vanes 304 and the variable speed drive of motor 204 may be adjusted to hold the building's temperature constant. If the building's heating load decreases (e.g., the building cools) and/or a desired temperature setpoint for the building increases (e.g., the building occupants are calling for less cooling), the variable speed drive is slowed and/or prerotation vanes 304 are adjusted to decrease the flow of refrigerant through compressor 206.

One strategy to achieve energy efficiency in chiller 14 is to operate motor 204 of compressor 206 at low rotational speeds for the target setpoints. However, compressor 206 can become unstable if the back pressure at the compressor's outlet becomes higher than that produced (i.e., output) by compressor 206, causing the flow of refrigerant in compressor 206 to momentarily reverse, and defining an event known as a surge. Surges can cause wear and tear and in some cases immediate damage to compressor 206 and system components. Because the conditions that cause a surge vary (e.g., due to different load conditions, temperature conditions, pressure conditions, prerotation vane positions, variable speed drive frequencies, flow rates, compressor characteristics, etc.) it is difficult to predict when surges will occur if a system is being controlled for energy efficiency (e.g., running the compressor at low rotational speeds relative to setpoints, etc.).

According to various embodiments of the disclosure, chiller 14 is controlled relative to a three dimensional surface map of surge information. Such surface maps may be referred to as "surge maps." The surge map stored or rendered as a three dimensional surface map can serve as a threshold between normal operational states and states in which a surge condition may exist or may be caused to exist. For example, the calculated surface map may be constructed using the axes of:

(1) prerotation vane position (PRV) or variable geometry diffuser (VGD) position, (2) differential pressure (DPP) (which may be computed by [(condenser pressure−evaporator pressure)/evaporator pressure]), and (3) variable speed drive (VSD) speed (e.g., frequency).

While many of the examples shown and described herein illustrate and discuss PRV, DPP, and VSD speed, in other embodiments and examples other chiller parameters may be identified, detected, calculated, stored, or otherwise used in the three-dimensional surface map display, control, or activities of the present application. For example, in some embodiments, an electronically controlled expansion valve of the chiller can be controllably adjusted and its position may be tracked as one of the dimensions in the coordinate system that describes surge events. In the same or other embodiments, a hot gas bypass valve configured to bleed pressure around the compressor can be controllably adjusted and its position may be tracked as one of the dimensions in the coordinate system that describes the chiller's condition during surge events. In the same or yet other embodiments, a variable geometry diffuser may act on the output of the compressor and can be controllably adjusted. The variable geometry diffuser's setting or position may be tracked as one of the dimensions in the coordinate system that describes the chiller's condition during surge events. Any combination of the above manipulated variables of the chiller may be tracked, detected, identified, calculated, or otherwise used to generate, update, and/or use the surface maps and related control structures and activities as described herein. For example, the three dimensions of a surge surface map as described herein may be expansion valve position, VSD frequency, and VGD position in some exemplary embodiments.

Coordinates in the three dimensional system associated with surge events occur and can then be recorded. In other words, as surge events are detected, the chiller conditions at the time of the surge event are recorded and stored as a point in the three dimensional coordinate system. Stored surge points can then be linked (e.g., graphically, mathematically, in memory, etc.) to form the surface map. The chiller's controller can use the formed surface map as a boundary that separates normal operational states for chiller 14 and states in which a surge condition may exist. In this way, chiller 14 can be controlled for energy efficiency by operating the chiller at a minimum variable speed drive frequency (i.e., speed), while avoiding potentially damaging surge events. By controlling relative to a three dimensional surface map rather than a simple threshold or thresholds, it may be possible to achieve greater energy efficiencies that systems using the simple threshold calculations.

Figure 4:
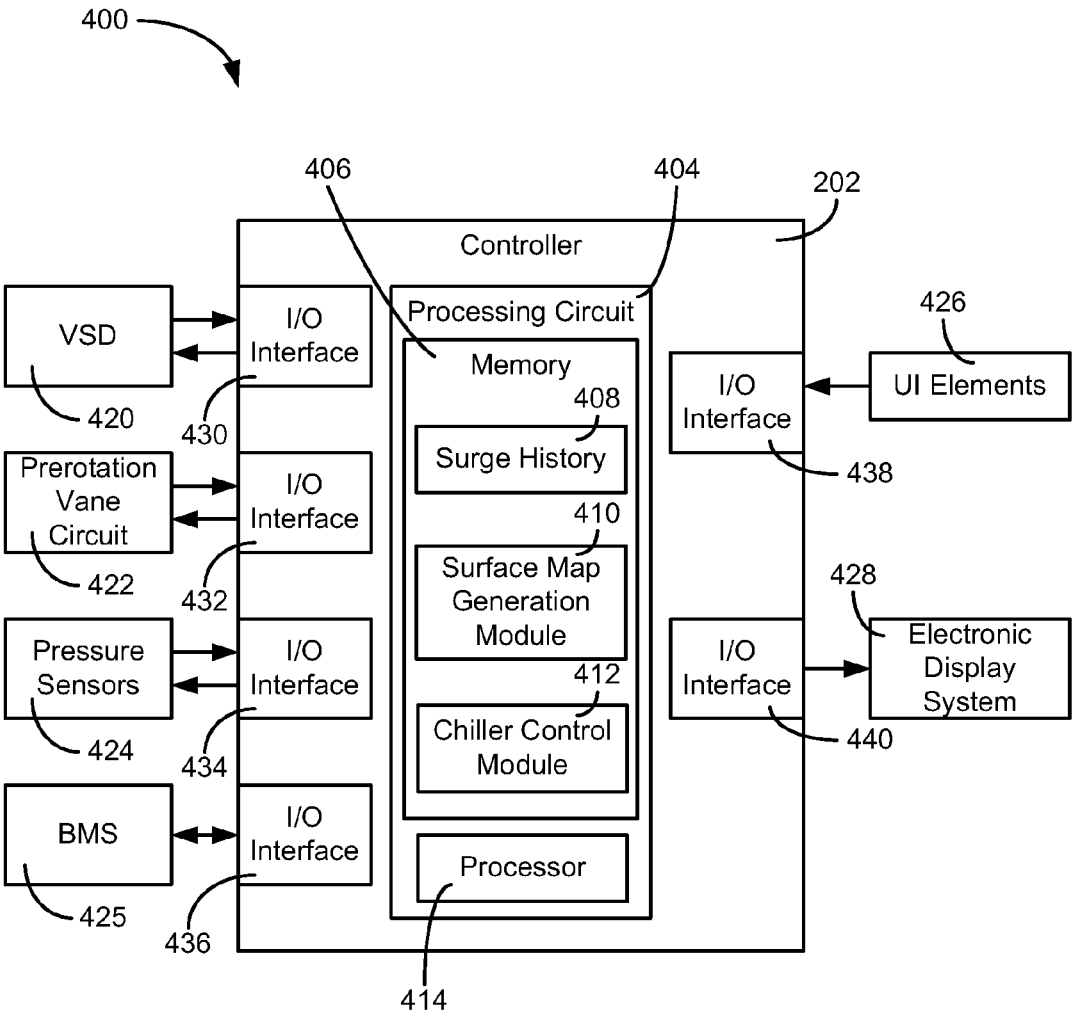
FIG. 4 is a block diagram of a chiller controller, according to an exemplary embodiment.

FIG. 4 illustrates an exemplary block diagram of a system 400 for controlling a chiller, according to an exemplary embodiment. Controller 202 is configured to detect and log (i.e., store) surge events in memory 406 generally, and in surge history 408 more particularly. Controller 202 calculates a point for each detected surge event in a three dimensional coordinate system to describe at least three conditions of the chiller when the surge event was detected. Controller 202 then uses a surface map generation module 410 to calculate a surface map for the three dimensional coordinate system using the calculated points and stored points. Controller 202 adjusts and controls at least one setpoint for the chiller (e.g., prerotation vane position, variable speed drive speed, etc.) based on the calculated surface map.

System 400 is shown to include a variable speed drive (VSD) 420, a prerotation vane circuit 422, pressure sensors 424, and a building management system (BMS) 425. Controller 202 is shown as coupled to UI elements 426 (e.g., mouse, keyboard, touch screen areas) and an electronic display system 428 (e.g., LCD, CRT, touchscreen, etc.). Controller 202 also includes a number of input and output (I/O) interfaces 430, 432, 434, 436, 438 and 440 for providing information to or for receiving information from connected devices or systems. The I/O interfaces 430, 432, 434, 436, 438 and 440 may be or include jacks or terminals of varying types and may include circuitry for filtering or otherwise transforming information passing through the I/O interfaces. The I/O interfaces 430, 432, 434, 436, 438, and 440 may be configured to communicate via similar or different protocols.

Referring still to FIG. 4, controller 202 includes a processing circuit 404 (e.g., "processing electronics"). Processing circuit 404 is shown to include memory 406 and a processor 414. Processor 414 may be a general purpose processor, an ASIC, or another suitable processor configured to execute computer code or instructions stored in memory 406. Memory 406 may be hard disk memory, flash memory, network storage, RAM, ROM, a combination of computer-readable media, or any other suitable memory for storing software objects and/or computer instructions. When processor 414 executes instructions stored in memory 406 for completing the various activities described herein, processor 414 generally configures controller 202 and more particularly processing circuit 404 to complete such activities. Said another way, processor 414 is configured to execute computer code stored in memory 406 to complete and facilitate the activities described herein.

In an exemplary embodiment, processing circuit 404 is configured to detect a plurality of surge events (e.g., using pressure inputs from pressure sensors 424) and to calculate a point for each detected surge event in at least a three dimensional coordinate system that describes at least three conditions of the chiller when the surge event was detected (i.e., conditions of the chiller associated with the surge event). Processing circuit 404 is further configured to calculate a surface map for the at least three dimensional coordinate system using the calculated points and to control at least one setpoint for the chiller using the calculated surface map.

Memory 406 is shown to include surge history 408, surface map generation module 410, and chiller control module 412. Surge history 408 may be an array, relational database, table, linked list or other data structure configured to store information regarding surges. Surface map generation module 410 is a computer code module (e.g., function, class, object, code section, combination thereof, etc.) configured to use surge history 408 to calculate a surface map based on the history. Chiller control module 412 may include computer code or hardware circuitry configured to control one or more variables for the chiller (e.g., a VSD speed setting, a prerotation vane position, a pressure target, etc.) using the surface map calculated by surface map generation module 410. Chiller control module 412 also uses setpoint information (e.g., target chilled fluid temperature, chiller demand signals, etc.) to conduct its control of the one or more chiller control variables. For example, in some embodiments, chiller control module 412 attempts to drive VSD power as low as possible while attaining a received chilled fluid setpoint demanded by a BMS (e.g., an HVAC supervisory controller of the BMS). Because multiple chiller control variables (e.g., three) can be adjusted while the chiller control module seeks energy efficiency and setpoint performance targets, the chiller control module 412 can use the three dimensional (or more) surface map to constrain its behavior (e.g., prevent the VSD speed setting from dropping such that a surge is experienced). Chiller control module 412 can also used the three dimensional surface map to seek greater energy efficiency while attaining the target chilled fluid setpoint. For example, the chiller control module 412 may be able to find combinations of three chiller control variables that result in lower energy expenditure while attaining or maintaining the target chilled fluid setpoint (e.g., finding prerotation vane positions and differential pressure positions that allow VSD frequency to be reduced).

While processing circuit 404 is shown to include particular modules for completing activities of the present disclosure, it should be noted that processing circuit 404 may include other modules or that an activity described with respect to one module (e.g., surface map generation module 410) may be completed by another module or by a combination of modules. Further, in some embodiments, "processing circuit" or "processing electronics" as used in the present disclosure can extend to distributed processing systems wherein one or more of the processing activities are completed by a different processor or system (e.g., a computer module of the BMS).

Figure 5A:
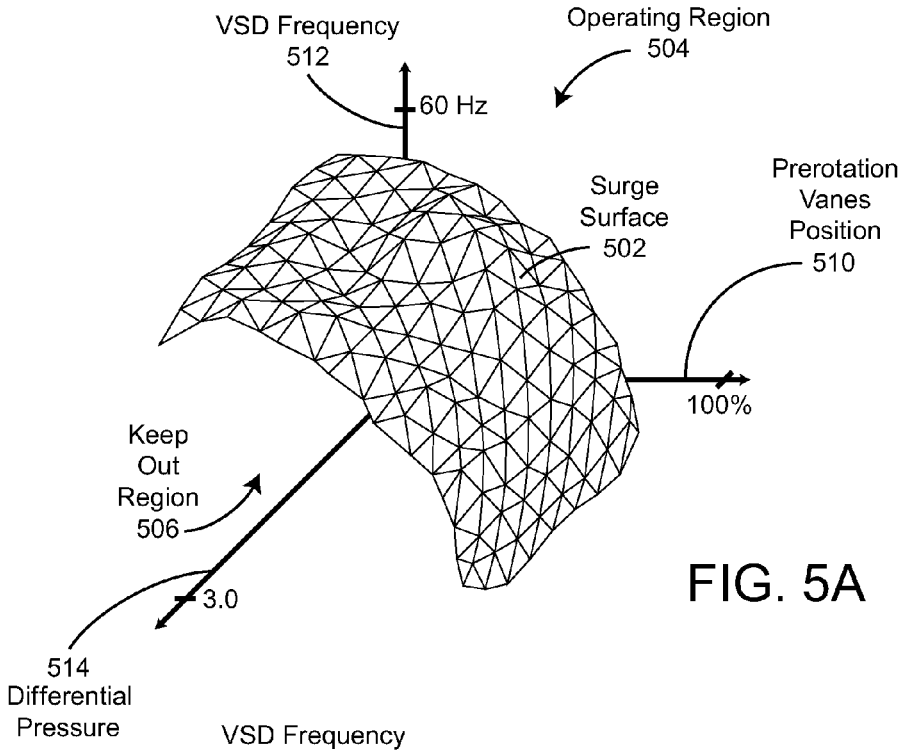
FIG. 5A is a graphical representation of a surge map, according to an exemplary embodiment.

Referring now to FIG. 5A, a graphical representation of a surface map (i.e., "surge map") that may be generated by the systems and methods of the present disclosure is shown. The surface map is plotted in a three dimensional coordinate system with each axis being a condition or manipulated variable of a chiller. A point on the surface map describes at least three conditions (e.g., corresponding to the three axes of the coordinate system) of the chiller when a surge event was detected. For example, the axes may be VSD frequency 512, prerotation vane position 510, and differential pressure 514. In the embodiments shown, the surface map is plotted with points on the three dimensional coordinate system where surge events have occurred.

As the surface map is constructed, a "keep out region" 506 is developed as an area on or under the surge surface 502 of the surface map and an operating region 504 is developed above the surge surface 502. An initial surface map may be created by using characteristics of the chiller system (e.g., evaporator size, condenser size, compressor properties, etc.). The initial surge map may also be created by purposefully operating the chiller until surge events are caused and mapping the points based on actual conditions that provide a surge. In yet other embodiments, the controller does not include an initial surge map and one is created dynamically as surges naturally occur. In any of the above embodiments, however, the surge surface map 502 is dynamically updated and maintained as surge events occur and as the chiller is operated.

Figure 5B:
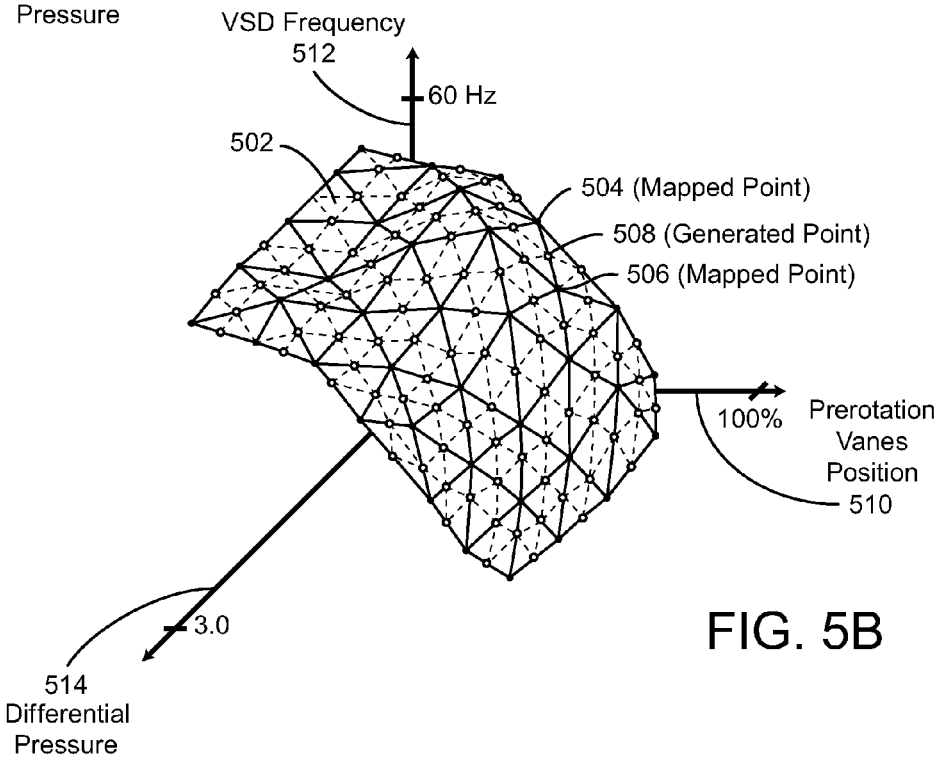
FIG. 5B is a graphical representation of a surge map including estimated surge points, according to an exemplary embodiment.

Referring now to FIG. 5B, systems and methods of the present disclosure are configured to generate a surge map where some of the points on the map are generated or estimated surge points rather than mapped points (i.e., points that represent an actual compressor surge). These generated points (e.g., generated point 508) are intended to provide for increased surge map resolution relative to a map that is only plotted using actual surge points (e.g., mapped points 504, 506). The generated points may be calculated by one or more interpolation processes (e.g., linear interpolation, trilinear interpolation, multivariate interpolation, polynomial interpolation, spline interpolation, etc.), curve fitting processes, regression analysis, or other method for constructing new data points within the range of actual surge points.

In some embodiments, surge map resolution is increased using other techniques or the other techniques working in conjunction with generated (i.e., interpolated) surge points to provide the increased resolution. For example, in one embodiment, VSD Frequency 512 (or another axis) is configured to provide for half-step plot points to effectively double the resolution of the surge map. Even in the event that a VSD does not allow for actual control to half-step setpoints, the generated points of the surge map may be placed at half-step values closest to the estimated surge. According to an exemplary embodiment, a controller configured to provide energy optimizing control algorithms by reducing the VSD speed to the lowest operating value possible may be able to further increase chiller efficiency by determining that a VSD can be set to a lower frequency while avoiding an estimated (generated) surge point.

Figure 6A:
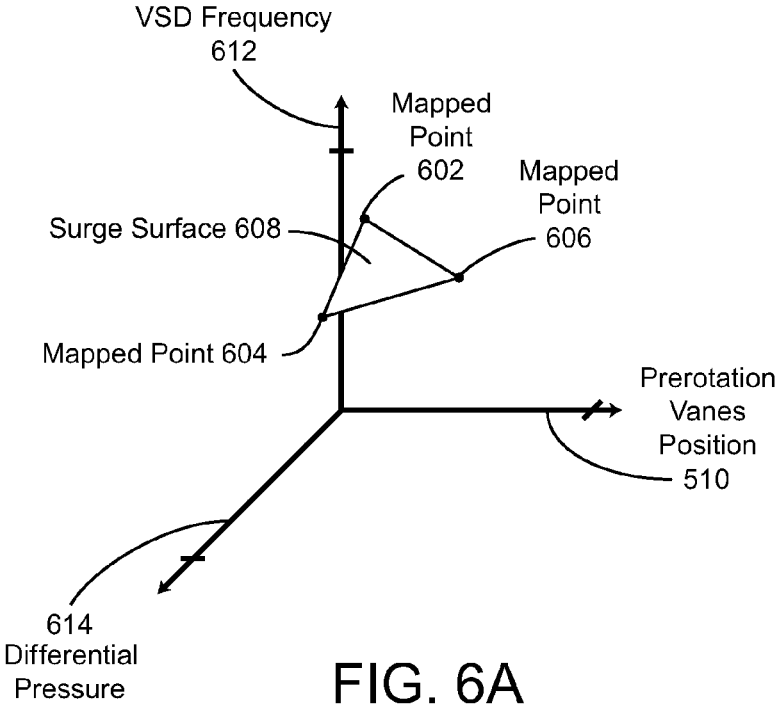
FIGS. 6A-6C illustrate the construction of a surge surface map, according to an exemplary embodiment.

Referring now to FIG. 6A, construction of a surge map is shown, according to an exemplary embodiment. The surge map is constructed initially using an algorithm for calculating and creating piece-wise linear surfaces. After the first two surge points are mapped (e.g., mapped points 602, 604), the first line can be calculated and drawn between the points. When a third surge point is detected (e.g., mapped point 606), a surface 608 can be constructed (e.g., by forming a triangle).

Figure 6B:
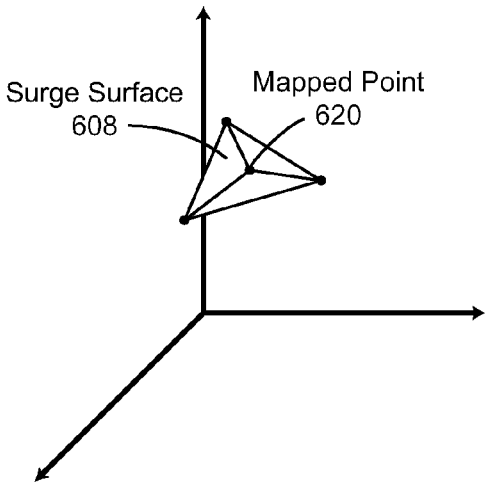
Figure 6C:
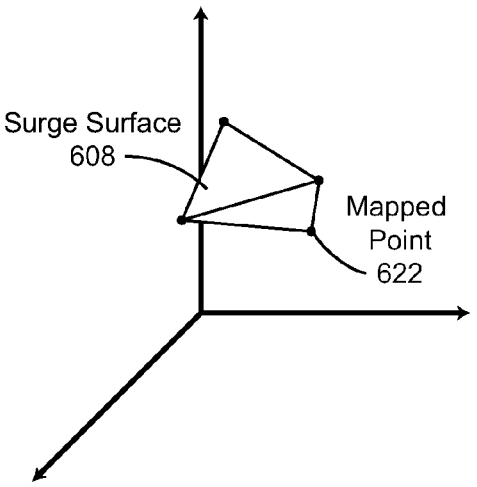

In FIGS. 6B-C, subsequent mapped surge points may use the two points nearest in distance to establish a new surface or surfaces if contained within the current surface. As new mapped surge points are added (e.g., mapped points 620, 622), updates to the affected surfaces are performed. A large surface connecting actual mapped points may also be divided into multiple smaller surfaces by calculating and placing generated points (not representing actual surge points, but rather representing estimated surge points) in the surface map. In some embodiments, the surface map may be created by calculating a curve fit to mapped surge points by a polynomial curve fitting algorithm, a three dimensional linear regression fitting algorithm, or another "curve" generating algorithm.

Figure 6D:
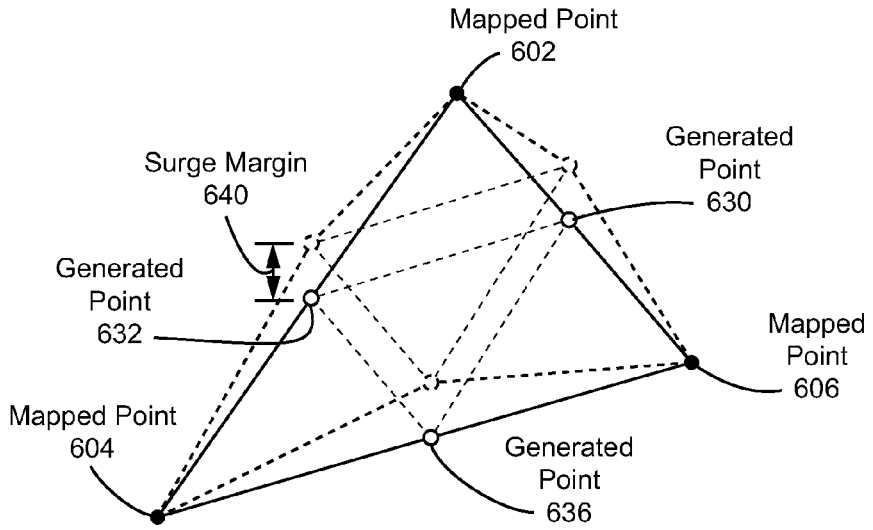
FIG. 6D illustrates a surge surface map having a surge margin, according to an exemplary embodiment.

Referring now to FIG. 6D, the systems and methods of the present disclosure may be configured to raise or extend the surface map or indicia near the surface map to identify a surge margin 640 for operating the chiller. The surge margin 640 may be calculated to provide, for example, a minimum set of values for chiller setpoints (e.g., VSD speed, prerotation vane position, pressure differential) that are estimated to provide headroom relative to the surface map (at the surface of which a surge is expected to occur or has occurred in the past). For example, a surface map containing mapped points 602, 604 and 606 and generated points 630, 632, 634 may be shifted along the axis for VSD frequency 612 to generate a new surface map defining surge margin 640. In some embodiments, surge margin 640 may be used as a safety margin or a warning margin within which the controller allows the chiller to operate but which results in an alert or warning state. In some embodiments, the chiller controller allows the operating conditions for the chiller to fall below the surge margin during times when a utility has called for power demand to be curbed or in response to high energy prices. In such situations, a surge may be risked to meet energy curbing goals. The chiller controller may not allow chiller operation below the surge margin in other situations (e.g., if a high priority event is occurring in a building, the possible energy efficiency gains provided by operating below the surge margin may not outweigh the risk of chiller downtime in the event of a surge-related failure). The surge margin may be user-adjustable or system-adjustable based on, e.g., the last surge point, a trend involving surges, or other surge history. For example, the controller may raise the surge margin in response to recognizing that one or more recent actual surges have been above the surface map (e.g., caused the surface map to be raised when updated). The controller may interpret such recent surge behavior as a trend that the chiller is surging earlier due to environmental or equipment conditions. If the surface map is displayed to a user via an electronic display, a user may recognize this trend and take investigative or diagnostic action. In other embodiments, if the controller automatically recognizes a surface map trend and takes some action (e.g., raising the surge margin, raising a portion of the surface map beyond a threshold raise amount, etc.), the controller may send a message to a user (e.g., via text message, e-mail, via the BMS, via an electronic display, etc.).

In some embodiments, the chiller controller may perform surge map updates via expiration of mapped or generated surge points. The expiration may occur due to a time threshold being exceeded (e.g., an auto-timeout feature) or a series of other conditions (e.g., the slope between surge points is greater than a threshold that suggests an unnatural difference between nearby system conditions). In one embodiment, expiration of a mapped point causes the nearest generated points to also expire or to be recalculated (e.g., smoothed, a new interpolation to be detected, etc.). For example, if mapped point 604 expires, generated points 632, 636 may also expire and be recalculated for a new interpolation between remaining actual surge points. For example, mapped points 602, 606 and generated points 632, 636 can be interpolated after expiration of mapped point 604 to create a generated point at or near the former location of mapped point 604.

Figure 6E:
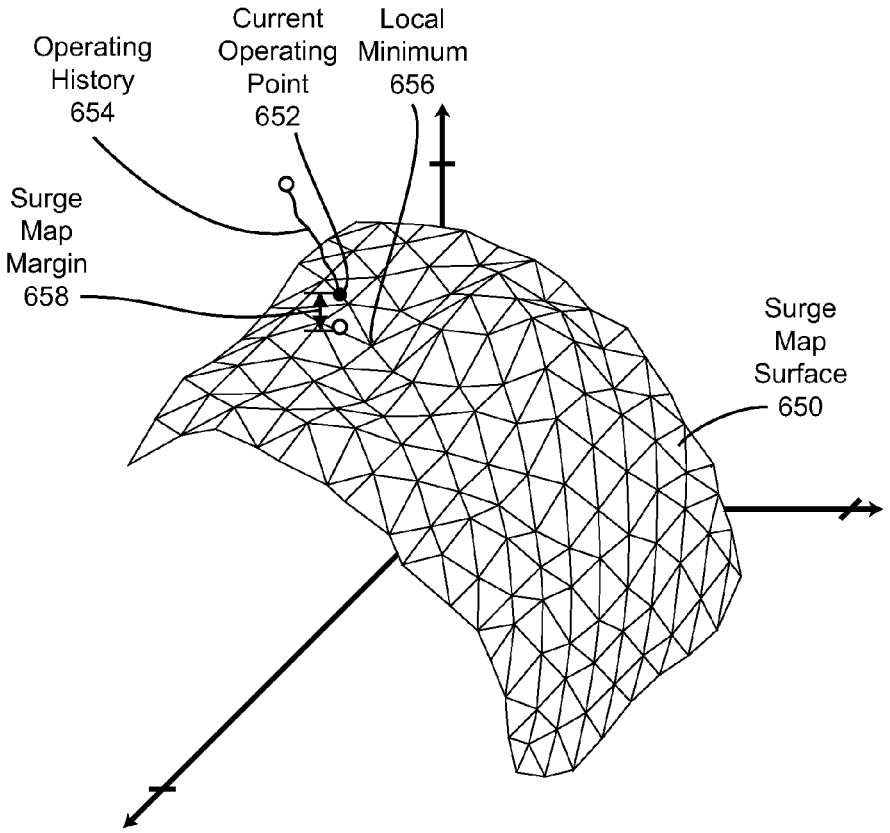
FIG. 6E illustrates operating history trails, surge map margins, an indicator for a current operating point, and other graphical user interface features of exemplary surge maps, according to an exemplary embodiment.

FIG. 6E illustrates additional control or graphical user interface features of an exemplary chiller controller. In an exemplary embodiment, the chiller controller is configured to drive a current operating point close to the surface map with the goal of energy efficiency. The chiller controller may drive the current operating point toward the surface map at a first speed when an actual surge point is being approached and drive the current operating point toward the surface map at a second speed when a generated surge point is being approached. For example, as current operating point 652 nears surge map surface 650 or surge map margin 658, the controller can alter the operating setpoints of the chiller to cause current operating point 652 to slow down its descent to surge map surface 650 or surge map margin 658. If the current operating point 652 is descending toward a generated point, the descent may be slowed even greater (e.g., due to the generated point being estimated and not actual). In this way, the system can operate more cautiously around areas of a surge map having unknown surge points.

In varying exemplary embodiments, the trajectory of current operating point 652 may be calculated by the chiller controller. Using such a calculation, the chiller controller can begin slowing down or backing away from the surface map to avoid surges. In an exemplary embodiment, the chiller controller calculating or determines a current state of the chiller and predicts whether a surge condition will occur based on at least the current operating state and the surface map. In varying exemplary embodiments, the controller can use a surge history to determine whether an operating trend exists that indicates a surge condition will be reached. If a surge is predicted by the chiller controller, the chiller controller can implement a control measure estimated to avoid the predicted surge condition. Prediction of future surges based on historical and current operating conditions can be calculated by applying a Kalman estimator to operating history 654 and new operating points.

In some chiller controller embodiments, generated points may be approached more quickly than actual surges. For example, the controller may be configured to approach generated points quickly or even to "test" generated points by breaking below the surface map. If a surge does not result when surge map surface 650 is crossed (i.e., broken), the generated point may be decreased and periodically retested. If a surge is experienced during the "test," the generated point may be replaced with an actual surge point and nearby generated points and/or the surface map may be recalculated. In yet other embodiments, minimums (e.g., local minimum 656) or maximums in the surge surface 650 may be tested to determine if they represent real minimums and maximums or anomalies (e.g., due to startup behavior, due to a spurious environmental condition, due to a temporary fault of the chiller, etc.).

In some embodiments, the chiller controller may include an "auto-tune" feature that may be manually or automatically invoked when a service event has occurred (e.g., condenser tubes cleaned, drive replacement, etc.). The tuning feature may also be invoked through a BMS which may determine that the tuning should be completed based on, for example, building configuration changes, temperature/humidity changes, occupancy changes, etc. The tuning feature may systematically or pseudo-randomly test areas of the surface map for surges (or the sensed onset of surge conditions). Such tuning may be configured to test a minimum number of points (e.g., ten, twenty, etc.) distributed over the coordinate system.

The tuning can be used to create an initial surface map which can then be updated dynamically as actual surges occur.

While the surge map surface 650 may be used to determine a "floor" for operating parameters of the chiller by the controller, the controller may also use the surge map for other control activities. For example, via user input or a controller algorithm, certain areas above the surge map may be identified as providing efficient or otherwise desirable behavior. These areas may be stored in memory with respect to the three-dimensional coordinate system or the map and the controller may attempt to move the current operating point 652 within or to this "target" area of the coordinate system. For example, the most efficient operating region may be identified as a subset of the operating area just above and to the right of surge map surface 650. This target area may be shaded green, have a circle drawn around it, or otherwise identified graphically on a display screen. Other areas (e.g., "danger zones") which may be undesirable due to out-of-bounds differential pressure, high VSD frequency, poor energy efficiency, higher likelihood of surges, or the like, can be shaded a different color (e.g., red) or otherwise identified. The varying zones on the map can be user entered via a graphical user interface or controller-defined based on equipment operating parameters, a system of rules, historical information, or other chiller information.

Figure 7:
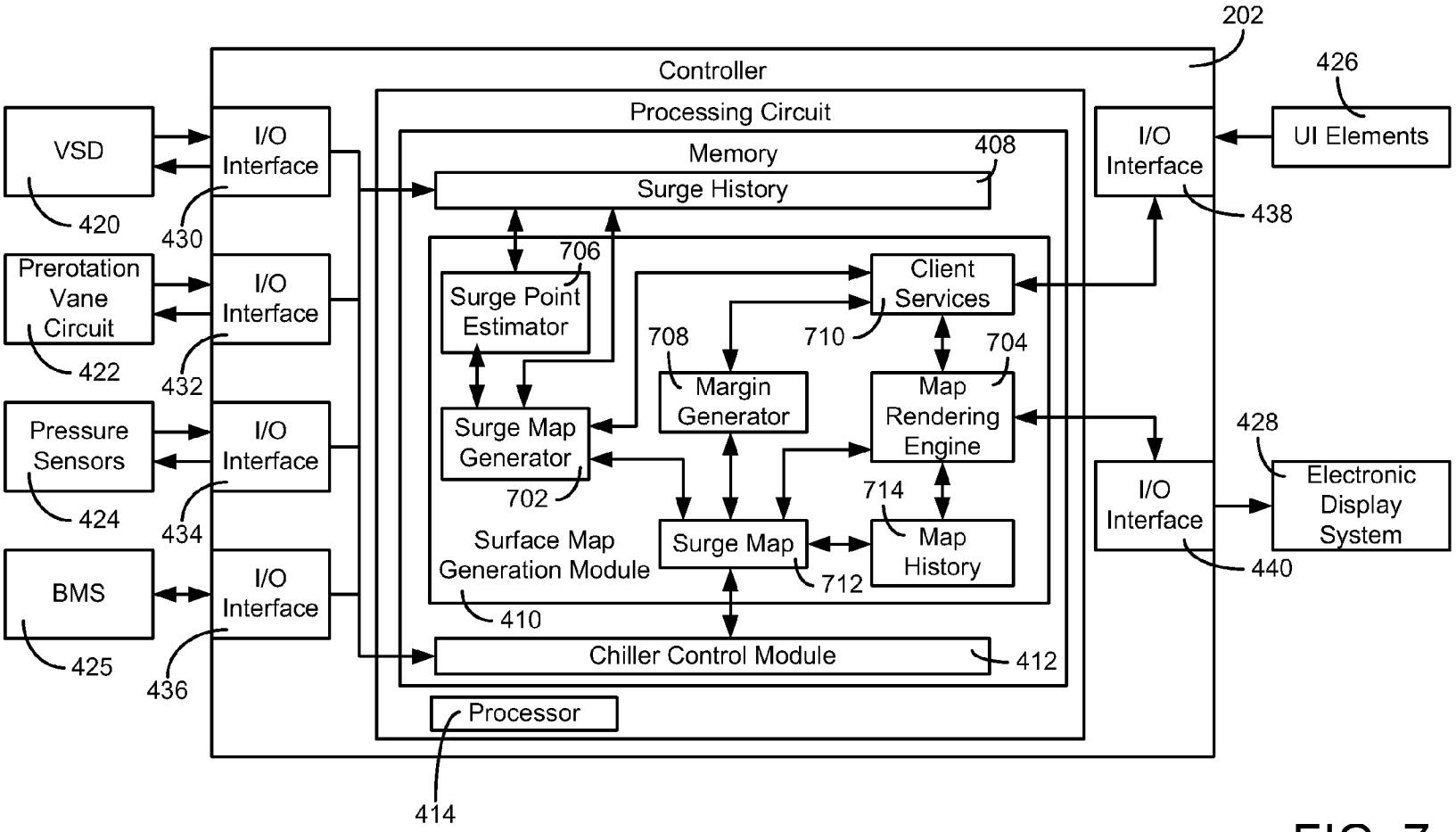
FIG. 7 is a detailed diagram of a chiller surge map generation module, according to an exemplary embodiment.

Referring now to FIG. 7, surface map generation module 410 of FIG. 4 is shown, according to an exemplary embodiment. Surface map generation module 410 receives historical data of detected surge events from surge history 408. The historical data may be previously calculated three dimensional coordinates. In another embodiment, the historical data may include raw measurements taken during a surge event and can be used to generate one or more coordinates. Surge map generator 702 uses the historical data to generate one or more surge maps 712. In some embodiments, surge map generator 702 generates surge maps 712 by using calculated lines and surfaces to connect the coordinates of surge points in surge history 408. For example, surge map generator 702 may use curve fitting techniques or any other techniques described above to connect the surge points.

Surface map generation module 410 is also shown to include surge point estimator 706, which estimates potential surge points (e.g., based on surge history 408, etc.). The estimated surge points from surge point estimator 706 may be provided to surge map generator 702 to generate or update surge map 712. In one embodiment, surge point estimator 706 uses detected surge points in surge history 408 to generate the estimated surge points. For example, a potential surge point may be estimated at a location at or near the midpoint between detected surge points. In another embodiment, surge point estimator 706 can estimate potential surge points using the characteristics (e.g. evaporator size, condenser size, compressor properties, etc.) of the chiller system. In yet another embodiment, surge point estimator 706 can estimate potential surge points using statistical techniques on surge history 408, surge map 712, and/or map history 714. For example, a statistical model can use previously detected surge points and changes in the surge map to predict new potential surge points. In yet another exemplary embodiment, surge point estimator 706 may be configured to record a surge point (e.g., actual or generated) when sensed conditions of the chiller indicate an oncoming surge (e.g., based on information provided by a pressure sensor at the output of the compressor, a pressure sensor provided at the input of the compressor, etc.). Accordingly, a "detected surge event" as described in this application can mean a detected imminent surge (e.g., based on sensor data or sensed operating conditions) even if the controller is able to cause the chiller to avoid an actual surge. In other embodiments, only actual surges may be considered detected surge events.

Surface map generation module 410 is also shown to include margin generator 708, which can use surge map 712 and/or user parameters from client services 710 to generate a surface margin. The generated margin may be a point, a line, a value, a surface, or another construct or set of rules that defines a threshold relative to surge map 712. The generated surface margin may also be used by surge map generator 702 to generate a second surface map that reflects a shifting of a first surface map in one or more coordinate directions. In one embodiment, the surge margin may be estimated using a forward estimating process. In other embodiments, margin generator 708 can be used to create multiple "layers" of surface maps (e.g., different zones in the coordinate system) which can be used as different layers of control. For example, surge margins may be used to create an imminent surge zone, a warning zone, and a safe zone in successive layers above the surge map. If the operating point moves from the safe zone to the warning zone, controller 202 may control the chiller to slow the descent toward an expected surge (e.g., slow a manipulated variable's approach toward that which is predicted to result in a surge condition). If the operating point moves from the first warning zone into imminent surge zone (i.e. nears the surface of the surge map), controller 202 may immediately pause or attempt to reverse the trend of one or more manipulated variables.

Surge map generator 702 receives surge point data from surge history 408, estimated surge points from surge point estimator 706, one or more surge margins from margin generator 708, and/or user parameters from client services 710 to generate a surge map 712. Surge map 712 may be or include one or more active surface maps for use by controller 202. For example, if multiple surge margins are used, surge maps 712 may include surface maps for each margin. Surge map generator 702 may use any known curve fitting technique to connect surge points from surge history 408 and/or estimated surge points from surge point estimator 706. In one embodiment, surge map generator 702 uses different curve fitting techniques depending on user preferences received from client services 710. For example, a user may prefer a lower resolution technique if the user determines that a high resolution map is resulting in an over-fitting condition.

Historical surface maps may be stored in map history 714 as new maps are generated by surge map generator 702. In some exemplary embodiments, map history 714 is maintained for particular periods of time (e.g., seasons, months, weeks, etc.) or operating conditions (e.g., heavy utilization, occupancy, weather states, etc.). These histories may be "swapped in" for surge map 712 (e.g., when the seasons change) to more accurately control for the conditions that a chiller will be experiencing in the future. In another embodiment, map history 714 may be used by surge point estimator 706 to estimate potential surge points. For example, trending changes in the previous maps may be used to estimate new potential surge points.

Surface map generation module 410 is further shown to include map rendering engine 704. Map rendering engine 704 communicates with I/O interface 440 to display surface maps on electronic display system 428. The displayed maps may be based on surge map 712 and/or map history 714. Map history 714 may be graphically represented as trail lines, a "ghost" map, different colors, via animation, or otherwise. A "ghost" map may refer to a map which displays a historical surge map as partially transparent, in broken lines, with a light color shade, or otherwise to indicate its age relative to the current map. Multiple historical surge maps from map history 714 may be shown on a single screen with the current surge map 712 to illustrate how operating conditions have changed over the past years, seasons, months, etc. In other exemplary embodiments, trends in the movement of surge map 712 may be calculated and future surge map values may be determined. Generated points may also be displayed using trend-based estimates for future surge parameters. In some embodiments, controller 202 may be configured to allow a user to recall a "time slice" of the surface maps for analysis or other use.

Client services 710 is shown to receive various user parameters from UI elements 426 via I/O interface 438. For example, controller 202 may receive a manual adjustment of a surge point via client services 710. Surge map generator 702 can use the user-specified surge points from client services 710 to generate surge map 712. Surge point estimator 706 can also utilize user parameters to select a computational technique (e.g., linear regression, linear interpolation, etc.) to estimate potential surge points. Margin generator 708 may utilize user parameters that specify a particular margin. Margin generator 708 may also utilize user parameters that provide criteria for the margin generation process. For example, a user parameter may specify that three margins are to be generated. Map rendering engine 704 may also utilize user parameters to render surge map 712 on electronic display system 428. For example, a user may specify that the area above a rendering of surge map 712 is to be colored green on electronic display system 428. Client services 710 may include one or more web servers, server modules, client-request listeners, or other modules for serving or generating user interfaces.

Figure 8A:
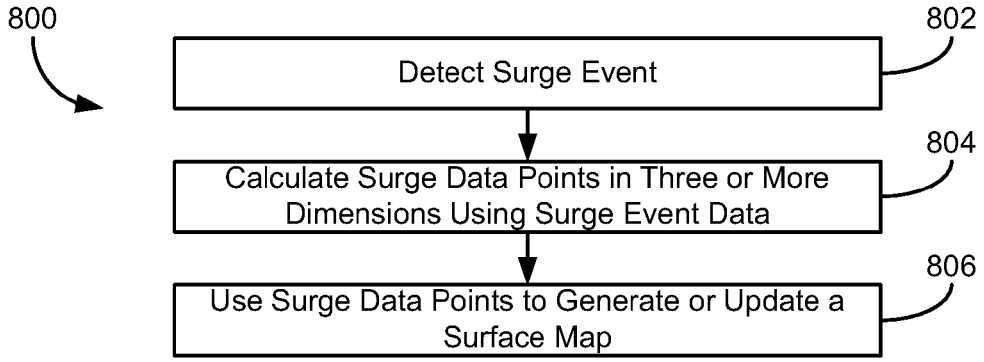
FIG. 8A is a flow chart of a process for generating a chiller surge map, according to an exemplary embodiment.

Referring now to FIG. 8A, a process 800 for generating a surface map is shown, according to an exemplary embodiment. Process 800 includes detecting a surge event (step 802). In general, a surge event in the chiller may exist if the pressure at the compressor's outlet becomes higher than that produced by the compressor. Process 800 also includes calculating surge data points in three or more dimensions using surge event data (step 804). Surge event data, i.e. the operating conditions of the chiller at the time a surge event is detected in step 802, may include a position of a prerotation vane, a VSD speed, measurements from sensors, or other information relating to the operation of the chiller. A coordinate in three or more dimensions can be formed using this data by assigning each type of data to a particular axis. Process 800 is further shown to include using surge data points to generate or update a surface map (step 806). The surge data points may be connected using a curve fitting technique such as linear interpolation or any other technique capable (e.g., as described above) of connecting the data points to form a surface map.

Figure 8B:
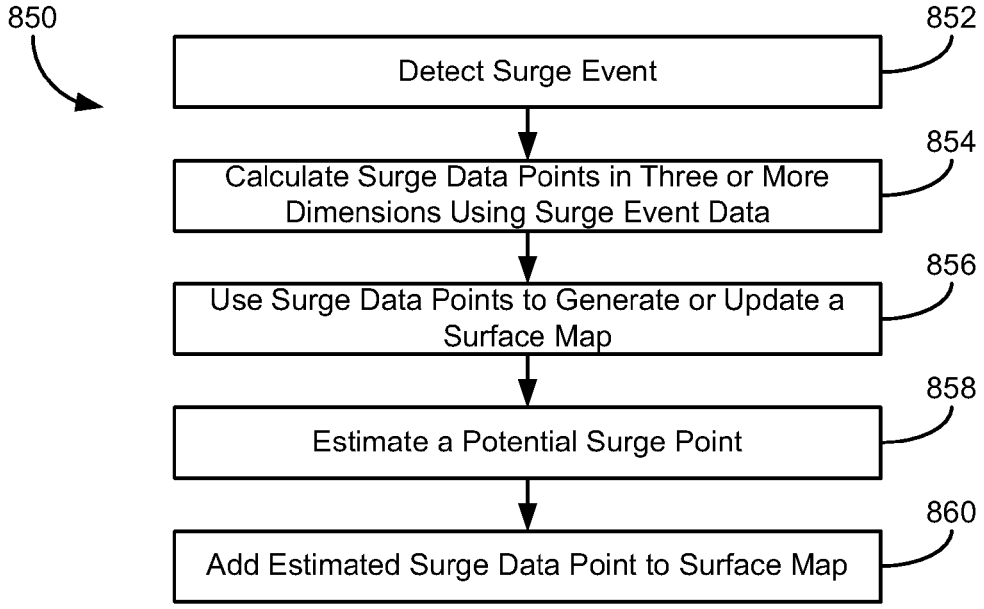
FIG. 8B is a flow chart of a process for generating a chiller surge map, according to another exemplary embodiment.

Referring now to FIG. 8B, a process 850 for generating a surface map with estimated surge points is shown, according to an exemplary embodiment. Process 850 includes the steps of detecting a surge event (step 852), calculating surge data points in three or more dimensions using surge event data (step 854), and using surge data points to generate or update a surface map (step 856). These steps may be performed in a manner similar to the steps of process 800.

Process 850 is also shown to include estimating a potential surge point (step 858). In one embodiment, potential surge points are estimated using the locations of surge data points detected in step 852. For example, a potential surge point may be estimated at a location at or near the midpoint between detected surge points. In another embodiment, potential surge points can be estimated using the characteristics (e.g. evaporator size, condenser size, compressor properties, etc.) of the chiller system. In yet another embodiment, potential surge points can be estimated using a history of detected surge points, previous surface maps, and/or surge margins. For example, a historical surge map for the previous summer months may be used to estimate potential surge points for the upcoming summer.

Process 850 is further shown to include adding the estimated surge data point to the surface map (step 860). Connections between existing surge points and the estimated surge data point may be redrawn to reflect the change to the surface map. A curve fitting technique may be used to redraw connections between the points. In this way, the surface map is updated using the estimated surge point.

Figure 9:
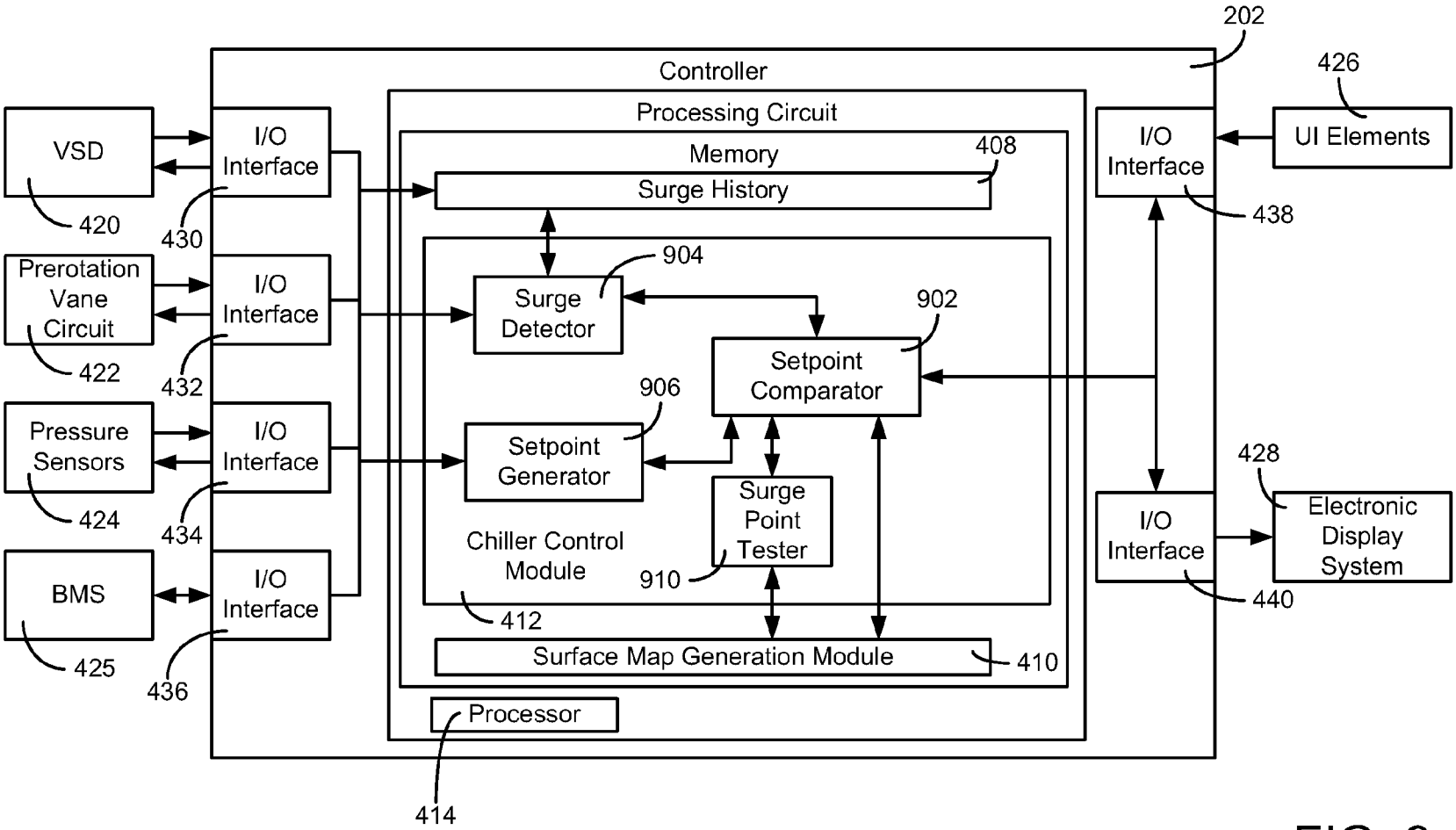
FIG. 9 is a detailed diagram of a chiller control module that makes use of varying chiller surge maps described herein, according to an exemplary embodiment.

Referring now to FIG. 9, chiller control module 412 of FIG. 4 is shown in greater detail, according to an exemplary embodiment. Chiller control module 412 is configured to monitor and control the chiller system (e.g. VSD 420, prerotation vane circuit 422, and pressure sensors 424) via interfaces 430, 432, and 434. Chiller control module 412 may also communicate with other components of BMS 425 (e.g., a supervisory controller, a Johnson Controls Metasys controller, etc.) via interface 436.

Chiller control module 412 is shown to include surge detector 904, which receives data from the chiller (e.g., from pressure sensors 424) to determine if a fault event exists. For example, a surge event may exist if data received from pressure sensors 424 indicate that the pressure at the compressor's outlet is higher than that produced by the compressor. If surge detector 904 detects a surge, data from the chiller (e.g. VSD 420, prerotation vane circuit 422, and pressure sensors 424) and/or from BMS 425 are converted into one or more three dimensional coordinates and stored as surge event data in surge history 908.

Chiller control module 412 is also shown to include setpoint comparator 902 which calculates the difference between the current operating point of the chiller and one or more surface maps from surface map generation module 410. In one embodiment, setpoint comparator 902 receives data from the chiller directly from interfaces 430, 432, and 434 to determine the current operating point. In another embodiment, the current operating point is determined by surge detector 904 and provided to setpoint comparator 902. Setpoint comparator 902 may also be configured to estimate a trajectory and motion of the operating point relative to a surface map and/or a margin. For example, setpoint comparator 902 may use a Kalman estimation to predict the future location and/or trajectory of the operating point. Setpoint comparator 902 may provide a graphical representation of the one or more surface maps to electronic display system 428 via interface 440. In another embodiment, setpoint comparator 902 provides the display data to map rendering engine 704 shown in FIG. 7 to display the current operating point, setpoint, and/or predicted trajectory in addition to, or in place of, the rendered surge maps.

Chiller control module 412 is also shown to include setpoint generator 906, which generates operating setpoints for one or more components of the chiller (e.g., a particular speed setpoint for VSD 420). When viewed graphically, setpoints provide a target location for operating points (e.g., current operating point 652 in FIG. 6E) in the coordinate system. Setpoint generator 906 may receive data from setpoint comparator 902 that indicates the current operating point's position relative to a surface map or margin. If the operating point is below, at, near, or approaching a surge region, setpoint generator 906 may generate a new setpoint above the surge map to move the operating point. In other embodiments, setpoint generator 906 receives a setpoint from a supervisory system in BMS 425, such as a master controller. In another embodiment, setpoint generator 906 may receive a setpoint from a user via UI elements 426 or electronic display system 428.

Chiller control module 412 is further shown to include surge point tester 910. Surge point tester 910 may be used by setpoint comparator 902 to "test" estimated surge points, i.e. to move the current operating point towards an estimated surge point. Surge point tester 910 receives estimated surge point data from surface map generation module 410 (e.g., from surge map 712, map history 714, and/or surge point estimator 706). Setpoint comparator 902 may use the estimated surge point data to determine a distance between the current operating point and the estimated surge point. If the distance is within a given threshold, surge point tester 910 may relay the coordinates of the estimated point to setpoint comparator 902 and/or to setpoint generator 906. In this way, chiller control module 412 may have multiple modes of operation. For example, the default configuration of setpoint generator 906 may be to calculate setpoints that control the operating point to avoid a surface map. However, if the operating point is near an estimated surge point, setpoint generator 906 may calculate other setpoints to control the operating point towards the estimated surge point. In another embodiment, setpoint generator 906 may generate setpoints that cause the operating point to behave "cautiously" when near an estimated point. For example, setpoint generator 906 may generate setpoints that cause the operating point to move at a reduced rate when in a region that contains estimated surge points and at a higher rate when in a region that contains detected surge points.

Figure 10:
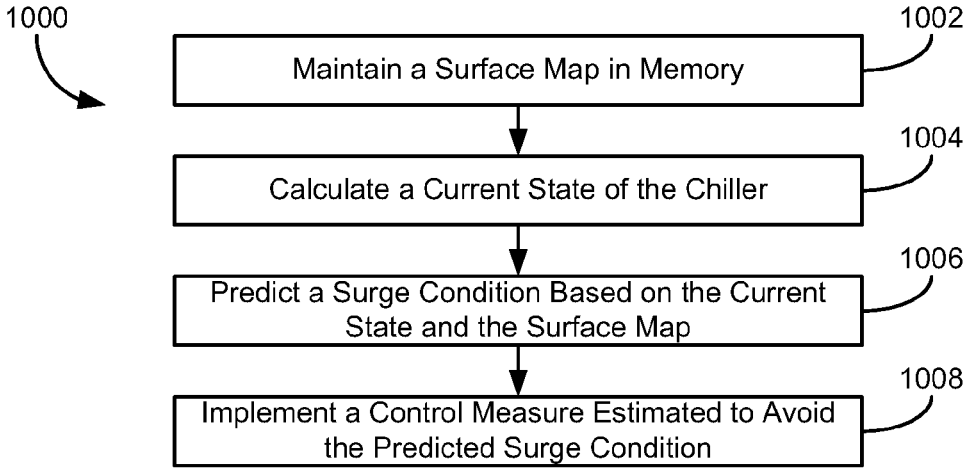
FIG. 10 is a flow chart of a process for avoiding surge conditions in a chiller using generated chiller surge maps, according to an exemplary embodiment.

Referring now to FIG. 10, a process 1000 is shown for avoiding surge conditions in a chiller, according to an exemplary embodiment. Process 1000 includes maintaining a surface map in memory (step 1002). In some embodiments, the surface map may be constructed using process 800 shown in FIG. 8A or process 850 shown in FIG. 8B. In another embodiment, the surface map may be based on physical characteristics of the chiller. In yet another embodiment, the surface map may be based on a historical surface map.

Process 1000 is also shown to include calculating a current state of the chiller (step 1004). The current state of the chiller may be calculated using one or more parameters received from, or provided to, the chiller. For example, the speed of the VSD, the prerotation vane position (PRV), and a differential pressure may be used to calculate the current state of the chiller. The current state of the chiller may be represented as a point in a coordinate system using the chiller's parameters as axes.

Process 1000 is further shown to include predicting a surge condition based on the current state and the surface map (step 1006). In one embodiment, a simple distance comparison is used to determine if the current state is near the surface map. For example, if the distance between the current state and the surface map is decreasing over time, the chiller may be nearing a surge condition. In another embodiment, surge margins may be used to provide one or more thresholds above the surface map to predict a surge condition. For example, if the operating point crosses a surge margin above the surface map, it can be predicted that the chiller's state is nearing a surge condition. In yet another embodiment, a history of chiller states can be used to estimate a location and/or a trajectory for the current state. If the trajectory intersects the surface map, the chiller may be approaching a surge condition.

Process 1000 is further shown to include implementing a control measure estimated to avoid the predicted surge condition (step 1008). A control measure may be an adjustment to one or more setpoints. Setpoints provide a target location for the current state when represented in a coordinate system. Setpoints that are directionally away from, or parallel to, a surface map defining a surge region may be used to avoid the predicted surge condition. In other embodiments, the control measure may be an immediate shutdown, startup, or non-gradual change in the operation of one or more components of the chiller.

Figure 11:
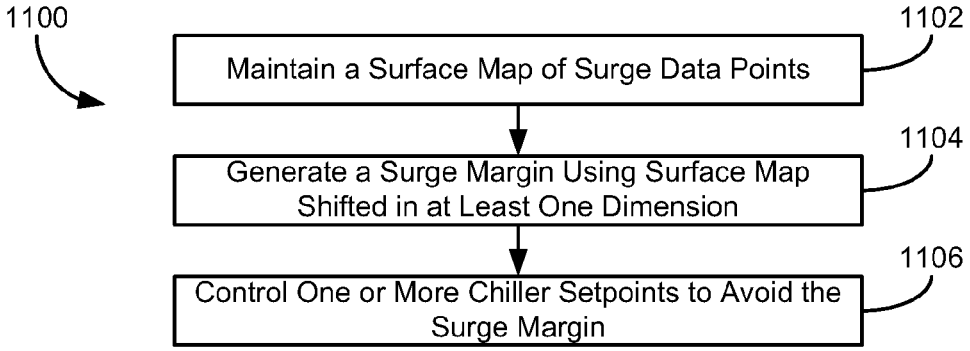
FIG. 11 is a flow chart of a process for using a surge margin of a chiller surge map for chiller control, according to an exemplary embodiment.

Referring now to FIG. 11, a process 1100 for using a surge margin (i.e., safety margin) is shown, according to an exemplary embodiment. Process 1100 includes maintaining a surface map of surge data points (e.g., a surge map) (step 1102). The surge data points may be detected surge points, estimated surge points, user-provided surge points, or a combination thereof. The surface map may be any representation of linked surge points. For example, curve fitting techniques (e.g. linear regression, interpolation, etc.) may be used to generate the surface map.

Process 1100 is also shown to include generating a surge margin using the surface map (step 1104). The margin may be any point, line, surface, etc. that provides a threshold relative to the surface map. For example, a surge margin may correspond to the surface map shifted in one or more dimensions. In another embodiment, the surge margin may not be uniformly distant from the surface map. For example, the surge margin may be smaller near regions of the map that contain detected surge points and larger near regions of the map that contain estimated surge points.

Process 1100 is further shown to include controlling one or more chiller setpoints to avoid the surge margin (step 1106). The chiller setpoints may be used to provide a target direction for the operating point. Setpoints that direct the operating point away from, or parallel to, the surface map may be used to avoid the surge margin.

Figure 12:
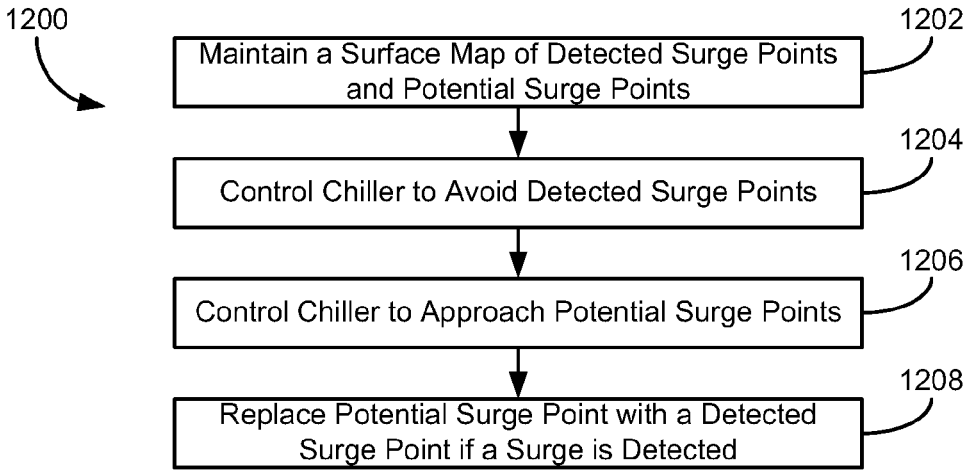
FIG. 12 is a flow chart of a process for validating estimated surge points on a chiller surge map, according to an exemplary embodiment.

Referring now to FIG. 12, a process 1200 for validating estimated surge points is shown, according to an exemplary embodiment. Process 1200 includes maintaining a surface map of detected surge points and potential surge points (step 1202). Detected surge points may be operating states of the chiller at the time of a surge event. For example, detected surge points may be based on data from the VSD, the prerotation vane, and pressure sensors in the chiller. In some embodiments, potential surge points are estimated using the detected surge points. For example, a potential surge point may be estimated as being located between two detected surge points. In another embodiment, characteristics of the chiller may be used to predict potential surge points. In yet another embodiment, a history of surge points may be used to predict future (i.e. potential) surge points.

Process 1200 is also shown to include controlling the chiller to avoid detected surge points (step 1204). The chiller may be controlled using setpoints or other techniques to cause the current state of the chiller to move away from detected surge points.

Process 1200 is further shown to include controlling the chiller to approach potential surge points (step 1206). The chiller may be controlled using setpoints or other techniques to cause the current state of the chiller to approach potential surge points. For example, a Kalman estimator may be used as part of a process that predicts (i.e., estimates) a future location and/or trajectory of the current operating point relative to the surface map. A threshold distance may also be used to determine whether to approach the potential surge points. Stated another way, the current operating point may only approach a potential surge point if the distance between the points is below a certain threshold distance.

Process 1200 is yet further shown to include replacing potential surge points with detected surge points if a surge is detected (step 1208). As a potential surge point is approached, a surge condition may be detected at or near the potential surge point. The potential surge point can then be removed from the surface map and replaced with the detected surge point. Existing surge points in the surface map can be connected to the newly detected surge point. Additionally, new potential surge points may be estimated using the detected surge point. In this way, the surface map can be updated to provide a more definite boundary for the surge region.

Figure 13:
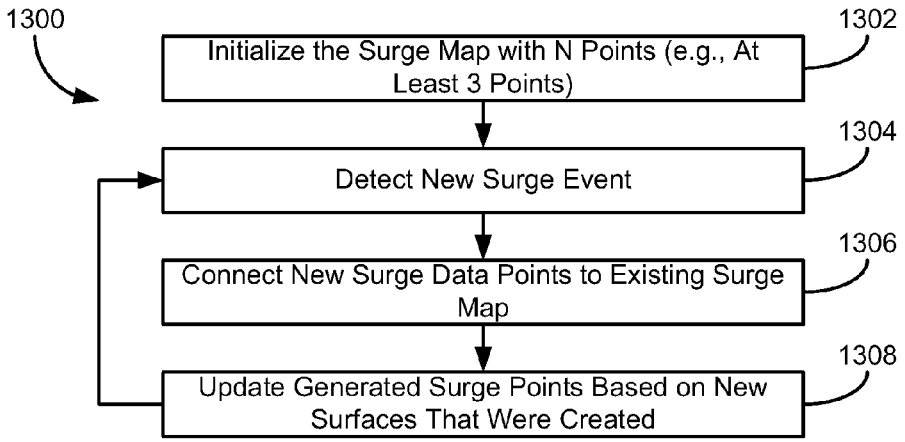
FIG. 13 is a flow chart of a process for generating and using a surge map, according to an exemplary embodiment.

Referring now to FIG. 13, a process 1300 for generating and using a surge map is shown, according to an exemplary embodiment. In process 1300, the surge map is initialized with N points (step 1302). In varying embodiments, N may be three points such that the first detected surge adds detail to an already-existing surge map surface. The N points may be selected based on chiller characteristics, based on a preloaded or default surge map, or otherwise. When a new surge is detected (step 1304), the chiller controller connects the new surge data point or points to the existing surge map (step 1306). As illustrated in another example herein, adding a fourth surge point may cause a triangle-shaped surface connecting three points to divide into two such triangles, and so on. In the illustrated embodiment of process 1300, the new or updated surfaces can be used to update any generated surge points (i.e., "virtual surge points", surge points not based on actual surges, surge points based on estimates, etc.) (step 1308). The process 1300 is then shown as looping back to step 1304.

Figure 14:
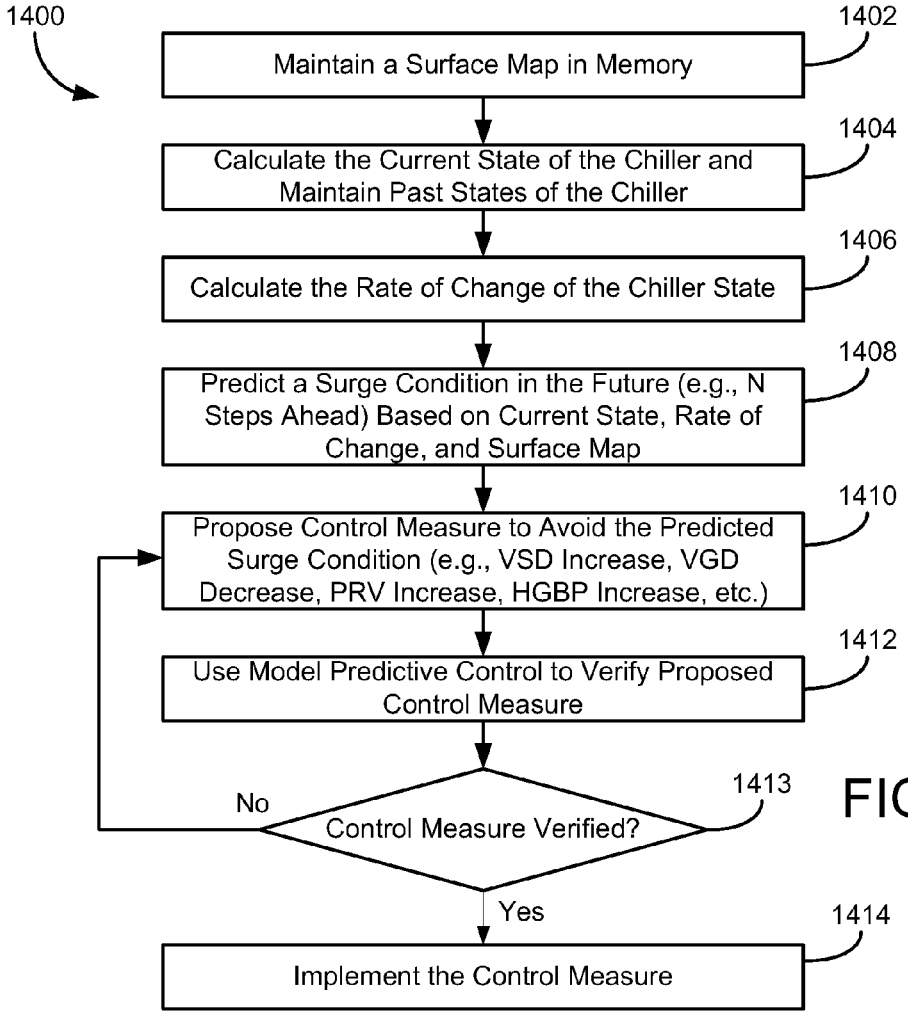
FIG. 14 is a flow chart of a process for using a surface map of surge points to select and implement a chiller control measure, according to an exemplary embodiment.

Referring now to FIG. 14, a process 1400 for using a surface map of surge points to select and implement a chiller control measure is shown, according to an exemplary embodiment. Process 1400 includes maintaining a surface map in memory (step 1402). In an exemplary embodiment, process 1300 of FIG. 13 may be used to generate and maintain said surface map. Process 1400 is further shown to include calculating a current state for the chiller and maintaining past states of the chiller (e.g., in memory, in a chiller history, as time-series data, etc.) (step 1404). Using the current state of the chiller and the past states of the chiller, a rate of change of the chiller state is calculated (step 1406). The rate of change may be described on three axes (e.g., in the three-dimensional coordinate system), with respect to one of the axes, with respect to a surface of the surge map detected to be normal to a movement vector of the operating point, or calculated and described in other ways. A surge condition in the future may be predicted (e.g., N steps ahead, a certain number of seconds ahead, a certain number of time constants ahead, etc.) (step 1408). The prediction may be based on the current state, the calculated rate of change, directionality associated with the rate of change (e.g., in the three-dimensional coordinate system), and based on the surface of the maintained surge map. When a surge condition is predicted to occur in the future, the chiller controller can process the current state, calculated rate of change, and other relevant chiller information to determine a control measure estimated to avoid the predicted surge condition. The control measure can be proposed (e.g., to a controller module that verifies the proposed control measure should avoid the surge, to an expert system that controls operation of the chiller, etc.) (step 1410). The proposed control measure can include, for example, a VSD frequency increase, a VGD decrease, a PRV increase, a hot gas bypass valve (HGBP) opening or adjustment, or a combination of control measures, a series of control measures, or any other suitable control measure or measures.

At step 1412 of process 1400, the process uses model predictive control (or another methodology for conducting testing or simulation) to verify that the control measure proposed at step 1410 is expected to avoid the predicted surge. Output from decision step 1413 can cause implementation of the control measure at step 1414 (e.g., if the control measure is verified as expected to avoid the predicted surge condition). If the model predictive control indicates that the that the proposed control measure is still predicted to cause a surge, the process 1400 can loop back to step 1410 and a different control measure may be selected for verification and potential implementation. In this way, even if the first selected control measure is not estimated to result in an avoided surge, the controller can try another control measure. At step 1414, the controller operating based on process 1400 can implement the control measure (e.g., send proper values or control signals to components of the chiller such as the variable speed drive).

Figure 15:
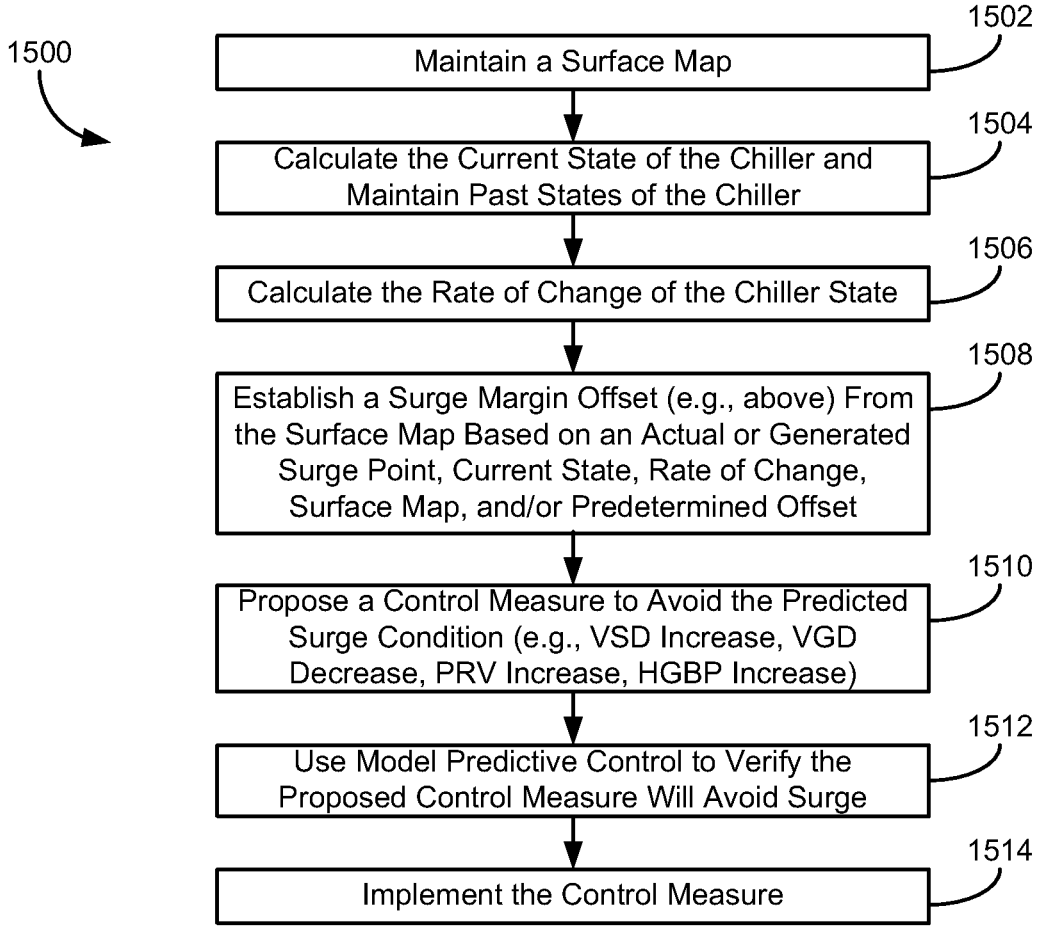
FIG. 15 is a flow chart of a process for implementing a control measure based on surge margin information, according to an exemplary embodiment.

Referring now to FIG. 15, a process 1500 for implementing a control measure based on surge margin information is shown, according to an exemplary embodiment. Process 1500 includes maintaining a surge surface map (step 1502), calculating the current state of the chiller and maintaining past states of the chiller (step 1504), and calculating the rate of change of the chiller state (step 1506). Steps 1502-1506 may be as described above with reference to FIG. 14 or another embodiment described in the present application. At step 1508, process 1500 includes establishing a surge margin relative to the surface map (e.g., above the surface map in three dimensions, above the surface map in one dimension, etc.). The surge margin can be established based on actual or generated surge points (or a combination of actual and generated surge points), the current surface of the surge map, surge history information, chiller state information, chiller state rate of change, and/or a predetermined offset (e.g., five percent above the surge surface, two speed levels above the VSD speed associated with a surge, etc.). A control measure can be selected and proposed for avoiding the predicted surge condition (step 1510), verified at step 1512, and implemented at step 1514. The prediction, verification, and implementation steps may be as described above with respect to FIG. 14 or as otherwise described in embodiments of the present disclosure.

Figure 16:
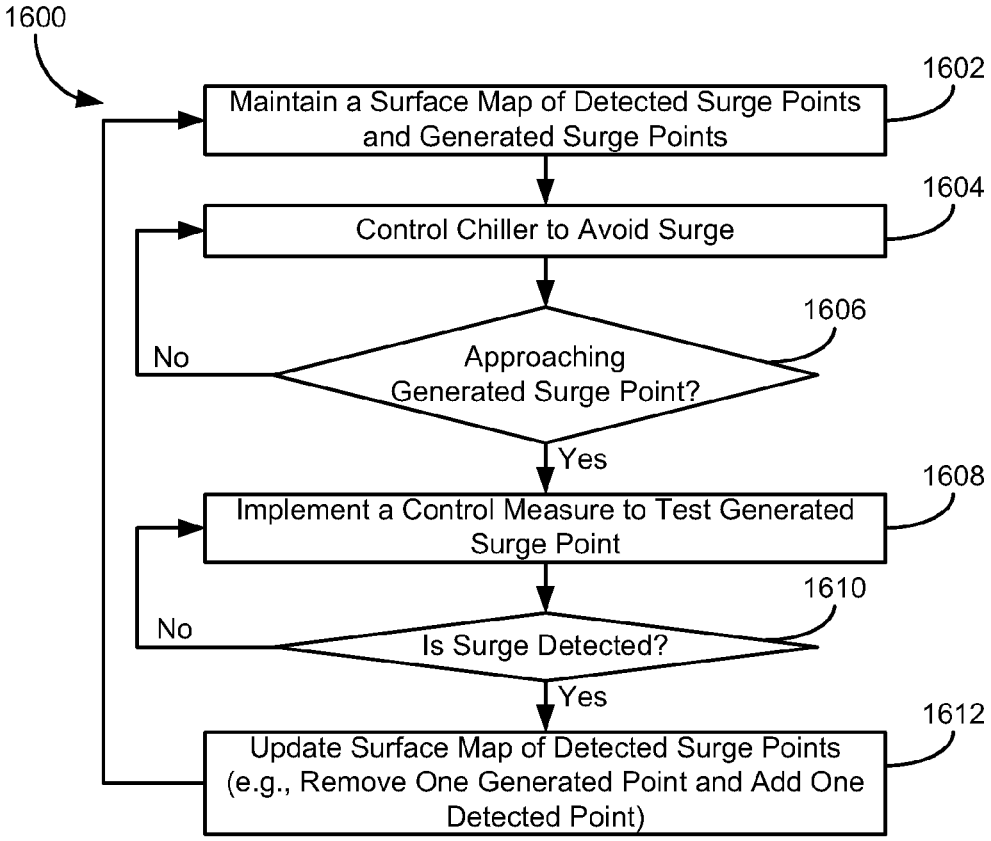
FIG. 16 is a flow chart of a process for validating generated (i.e., virtual, estimated, not actual, etc.) surge points, according to an exemplary embodiment.

Referring now to FIG. 16, a process 1600 for validating generated (i.e., virtual, estimated, not actual, etc.) surge points is shown, according to an exemplary embodiment. Process 1600 includes maintaining a surface map of detected surge points (i.e., actual surge points) and generated surge points (step 1602). As described elsewhere in this disclosure, the generated surge points can be established based on predictions, curve-fitting equations, gap-filling predictions, chiller models, or other processes for estimating points at which the chiller might surge. The chiller can then be controlled (e.g., using the detected surge points and the generated surge points, using the surface map, etc.) to avoid surge (step 1604). Process 1600 is shown to include a determination step that checks for whether one or more operating points of the chiller indicates that the chiller is approaching a generated surge point (e.g., approaching a surface map portion associated primarily with generated surge points rather than actual surge points, approaching a surge map surface point some number of points away from an actual surge, etc.). If the chiller is not approaching a generated surge point, the controller continues operating the chiller to generally avoid surges (e.g., actual surges) at step 1604. If the chiller is determined to be approaching a generated surge point, the controller can implement a control measure estimated to test a generated surge point (step 1608). If a surge is detected at step 1610, then the system will update the surface map of detected surge points (e.g., remove one generated surge point and replace it with a detected surge point) (step 1612). This removal or replacement can occur in memory and/or can be graphically indicated on a rendering of the surge map (e.g., the surge point can change from an open dot indicating a generated point to a black or solid dot indicating an actual surge point). If a surge is not detected when a control measure is executed to test the generated surge point then the system can loop back to step 1608 to continue testing the generated surge point. Testing a generated surge point can include causing a current operating point of the chiller to be held at the surface of the surge map for a period of time. In other embodiments, testing a generated surge point can include continuing to approach the generated surge point (but not actually reaching the generated surge point). In yet other embodiments, testing a generated surge point can include continuing to reduce one or more manipulated variables (e.g., VSD speed) until an actual surge is detected. In some embodiments, the controller will stop testing generated surge points and return to normal control even if an actual surge is not detected as a result of the testing. In such situations, the controller may adjust or change one or more generated points. For example, if process 1600 tests below the surface of the surge map but a surge is not detected, the controller can resume normal chiller control but lower the surge map to the tested point, below the tested point, or otherwise.

Figure 17:
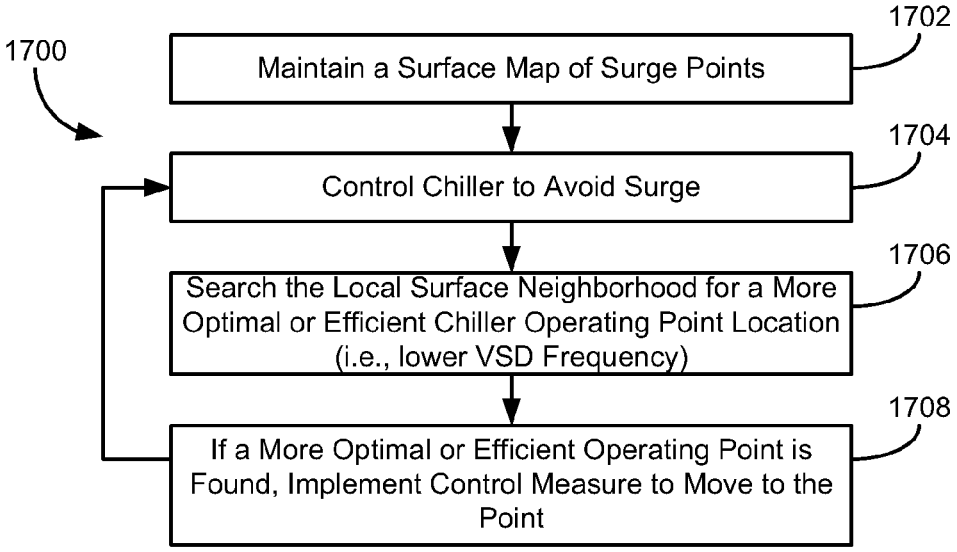
FIG. 17 is a flow chart of a process for finding an energy efficient operating point for a chiller, according to an exemplary embodiment.

Referring now to FIG. 17, a process 1700 for finding an energy efficient operating point for a chiller is shown, according to an exemplary embodiment. Process 1700 is shown to include maintaining a surface map of surge points (e.g., actual, generated, etc.) (step 1702). Process 1700 can generally include controlling the chiller to avoid surges (step 1704). During control of the chiller (e.g., periodically, continuously, in response to one or more conditions, in the absence of a demand signal from a utility, etc.) the controller can search the local surface neighborhood for a more optimal or efficient chiller operating point location (step 1706). The local surface neighborhood can be defined in different ways according to different embodiments. For example, in one embodiment, the neighborhood is defined in terms of a differential pressure and prerotation vane radius of some predetermined amount around the current operating point. Within the radius, for example, the controller may search for the lowest VSD frequency. If a more optimal or efficient operating point is found, the controller can then implement one or more control measures to move the chiller's operation to the identified point (step 1708). The one or more control measures may include, for example, moving the PRV position until the lowest VSD frequency identified in the search of step 1706 is reached.

Figure 18:
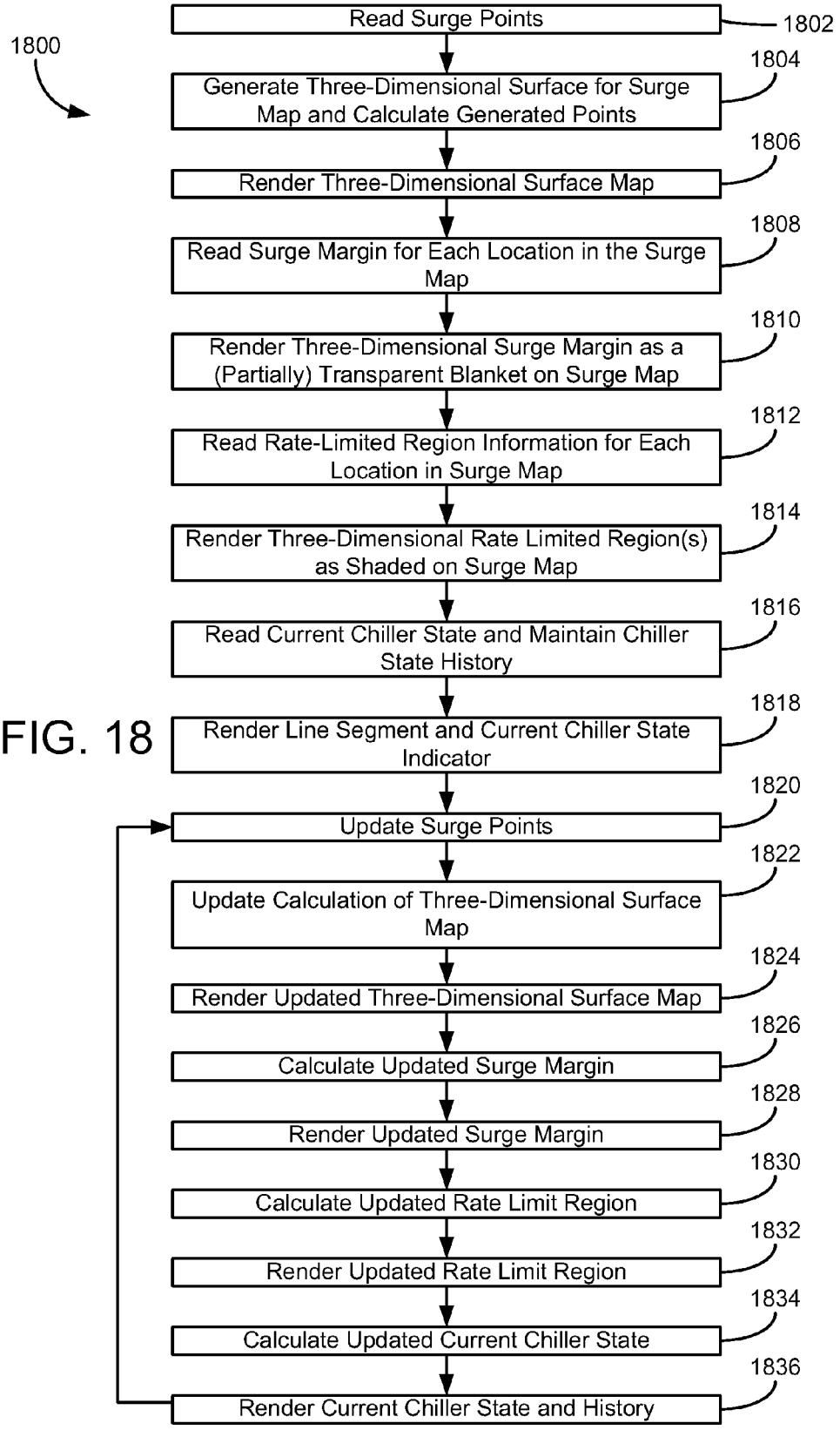
FIG. 18 is a flow chart of a process for using surge margins and surge surface maps with a graphical rendering for an electronic display, according to an exemplary embodiment.

Referring now to FIG. 18, a process 1800 for using surge margins and surge surface maps with a graphical rendering for an electronic display is shown, according to an exemplary embodiment. Process 1800 includes reading surge points (step 1802) (e.g., from memory, from a surge history, from a surge detection module, etc.). A three-dimensional surface for a surge map is then generated (step 1804). The three-dimensional surface map may be generated by conducting one or more triangle generation tasks, one or more curve fitting tasks, by estimating one or more generated surge points, or as otherwise described in the present application. The three-dimensional surge map may then be rendered at step 1806. Any computerized or graphical rendering technique of the past, present, or future may be used. Before, during, or after the surge map is rendered, process 1800 may include reading a surge margin for each location in the surge map (step 1808). In varying embodiments, the surge margin is constant across the surge map. In other embodiments, the surge margin is variable (e.g., gets thicker with coordinate positions associated with low VSD, gets thicker with coordinate positions associated with a high standard deviation of surge event data, etc.). The surge margin may be rendered as a three-dimensional partially transparent blanket on the surge map (step 1810).

In the embodiment shown in FIG. 18, process 1800 includes reading rate-limited region information for each location in the surge map (step 1812). One or more regions in the surge map (e.g., a region associated with low VSD, a high standard deviation of surge points, etc.) may be identified as a region where approach to the surface map should be rate limited beyond that normally provided by the surge margin. The rate limited regions can be rendered in three dimensions (another three dimensional blanket, layer, or margin) and shaded (e.g., a different color than the surge margin) (step 1814). In some embodiments, the rate limited region is positioned or rendered above the top surface of the surge margin layer. In other embodiments, portions of the rate limited layer may intersect with the surge margin layer and/or extend below the surge margin layer.

At step 1816 of FIG. 18, process 1800 can read the current chiller state and maintain a state history for the chiller. Based on the read information, a current state indicator (e.g., an icon, a point, etc.) can be rendered on the three-dimensional coordinate system with the surface map (step 1818). One or more line segments connecting the current state indicator to one or more historical points may also be rendered on the scene. The one or more line segments may form a curved chiller state history trail, a disappearing chiller state history trail, or any other rendering (e.g., semi-transparent) that illustrates the chiller state history. The surge points can be updated (step 1820) and the calculation of the three-dimensional surface map can be updated (step 1822). The updated three-dimensional surface map can then be rendered (step 1824). An updated surge margin can be calculated (step 1826) (e.g., based on new surge information) and the updated surge margin can be rendered with the surge map (step 1828). An update to the rate limit region can also be calculated (step 1830) based, e.g., on time since last surge, new surge data, new environmental data, user adjustment, or otherwise. The updated rate limit region can be rendered (step 1832). An updated current chiller state can be calculated (step 1834) and the current chiller state and history can be rendered (step 1836). For example, the current chiller state can be shown with a point and an updated history trail showing the last chiller state position. The history trail may have an end (e.g., distal the current chiller state point) that expires or disappears such that the history trail only shows the past M chiller states or chiller states over the past X minutes.

Many of the embodiments discussed herein may result in a graphical depiction of the surge map on a graphical user interface on an electronic display system. The surge map may also be stored in memory and used by a control algorithm of the chiller controller even if not displayed. In some embodiments the graphical representation may be manipulated using a user input device (e.g., mouse, joystick, multi-touch, etc.). The surface map may be transparent. In some embodiments multiple surface maps may be shown (an old surface map, a most recent surface map, a benchmark surface map for like chillers, etc.). In some embodiments an x, y, z printout or other indicator may be provided to a user as the user selects various points on the map.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although terms such as "above" and "below" are used in the present disclosure to denote coordinate locations in reference to one or more surface maps, it is to be understood that these terms are exemplary only and are not intended to be limiting. It is to be appreciated that the systems and techniques in the present disclosure may be applied to any surface map, regardless of orientation.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A controller for a chiller comprising:

processing electronics configured to detect a plurality of surge events and to calculate a point for each detected surge event in at least a three dimensional coordinate system that describes at least three conditions of the chiller when the surge event was detected;

wherein the processing electronics are configured to calculate a surface map for the at least three dimensional coordinate system using the calculated points;

wherein the processing electronics are configured to control at least one setpoint for the chiller using the calculated surface map;

wherein the processing electronics are configured to estimate a potential surge point and to add the estimated potential surge point to the surface map; and wherein the processing electronics are configured to classify the potential surge point as a generated surge point and a point calculated based on a detected surge point as an actual surge point.

2. The controller of claim 1, wherein the controller is coupled to an electronic display system and wherein the controller is configured to cause the electronic display system to display a rendering of the surface map.

3. The controller of claim 1, wherein the at least three conditions comprise at least one of: (a) compressor motor variable speed drive (VSD) frequency, and (b) compressor motor VSD speed.

4. The controller of claim 3, wherein the at least three conditions comprise:

compressor prerotation vane position or compressor variable geometry diffuser position; and at least one of:

(c) condenser pressure (CP), (d) evaporator pressure (EP), and (e) a difference between condenser pressure and evaporator pressure (CP-EP), and a differential pressure comprising CP-EP divided by EP.

5. The controller of claim 1, wherein the processing electronics are configured to define a surge region of the three dimensional coordinate system, and wherein the processing electronics are configured to conduct one or more control actions to prevent current operating conditions of the chiller from reaching the surge region.

6. The controller of claim 1, wherein the processing electronics are further configured to control the chiller differently when approaching an actual surge point relative to approaching a generated surge point.

7. The controller of claim 1, wherein the processing electronics are further configured to periodically control the chiller to test the generated surge points; and wherein the processing electronics replace the generated surge point with an actual surge point if the compressor surges when tested at the generated surge point.

8. The controller of claim 1, wherein the processing electronics are further configured to update the surface map and the generated surge points as new actual surge points are detected.

9. The controller of claim 1, wherein the processing electronics are configured to define a surge margin relative to the surface map and to avoid operating the chiller within the surge margin during control of the at least one controlled setpoint.

10. The controller of claim 1, wherein the processing electronics are further configured to update the surface map using at least one of polynomial curve fitting and a calculation based on linear regression.

11. The controller of claim 1, wherein the processing electronics are configured to associate a date with each actual surge point; and wherein the processing electronics are configured to compare the date associated with the actual surges with the current date and to remove actual surge points after a predetermined period of time.

12. A controller for a chiller comprising:

processing electronics configured to detect a plurality of surge events and to calculate a point for each detected surge event in at least a three dimensional coordinate system that describes at least three conditions of the chiller when the surge event was detected;

wherein the processing electronics are configured to calculate a surface map for the at least three dimensional coordinate system using the calculated points;

wherein the processing electronics are configured to control at least one setpoint for the chiller using the calculated surface map;

wherein the processing electronics are configured to associate a date with each actual surge point and wherein the processing electronics are configured to compare the date associated with the actual surges with the current date and to remove actual surge points after a predetermined period of time.

13. The controller of claim 1, wherein the processing electronics are configured to initiate a tuning procedure in response to at least one of:

(a) a power cycle;

(b) a command from a local user interface;

(c) a significant parameter change;

(d) an indication that service was conducted;

(e) an indication that a new part was placed into the system; and (f) a command from a remote system.

14. The controller of claim 1, wherein the processing electronics are configured to delay the detection and surface mapping activities until a predetermined time period after startup of the chiller has elapsed.

15. The controller of claim 1, wherein the processing electronics are configured to utilize defined energy efficient regions of the surface map and to control the chiller based on the defined energy efficient regions.

16. The controller of claim 1, wherein the processing electronics are further configured to receive user input signals from a user input device and wherein the user input signals are used to manipulate a graphical representation of the at least three dimensional coordinate system and the surface map.

17. The controller of claim 12, wherein the processing electronics are configured to estimate a potential surge point and to add the estimated potential surge point to the surface map; and wherein the processing electronics are configured to classify the potential surge point as a generated surge point and a point calculated based on a detected surge point as an actual surge point.

18. The controller of claim 17, wherein the processing electronics are further configured to control the chiller differently when approaching an actual surge point relative to approaching a generated surge point.

19. The controller of claim 17, wherein the processing electronics are further configured to periodically control the chiller to test the generated surge points; and wherein the processing electronics replace the generated surge point with an actual surge point if the compressor surges when tested at the generated surge point.

20. The controller of claim 17, wherein the processing electronics are further configured to update the surface map and the generated surge points as new actual surge points are detected.

21. A computerized method for controlling a chiller, comprising:

using processing electronics of a controller for the chiller to detect a plurality of chiller surge events;

using the processing electronics to calculate a point for each detected surge event in at least a three dimensional coordinate system that describes at least three conditions of the chiller associated with the detected surge event;

using the processing electronics to calculate a surface map for the at least three dimensional coordinate system using the calculated points;

using the processing electronics to control at least one setpoint for the chiller using the calculated surface map;

estimating a potential surge point and adding the estimated potential surge point to the surface map;

classifying the potential surge point as a generated surge point and classifying a point calculated based on a detected surge point as an actual surge point;

controlling the chiller differently when chiller conditions are approaching an actual surge point relative to when chiller conditions are approaching a generated surge point;

periodically controlling the chiller to test the generated surge points; and replacing the generated surge point with an actual surge point if the compressor surges when tested to the generated surge point.

22. The computerized method of claim 21, further comprising:

calculating a current state of the chiller;

predicting a surge condition based on the current state and the surface map; and implementing a control measure estimated to avoid the predicted surge condition.

23. The computerized method of claim 21, wherein the controller is coupled to an electronic display system and wherein the method further comprises:

causing the electronic display system to display a rendering of the surface map.

24. The method of claim 21, further comprising:

associating a date with each actual surge point; and comparing the date associated with the actual surges with the current date and removing actual surge points after a predetermined period of time.

* * * * *